US008542149B2

(12) United States Patent
Watanabe et al.

(10) Patent No.: US 8,542,149 B2
(45) Date of Patent: Sep. 24, 2013

(54) ANTENNA AND ELECTRONIC DEVICE EQUIPPED WITH SAME

(75) Inventors: Haruyuki Watanabe, Hitachi (JP); Naoki Iso, Hitachi (JP); Morihiko Ikegaya, Kasumigaura (JP); Tomoyuki Ogawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 624 days.

(21) Appl. No.: 12/718,025

(22) Filed: Mar. 5, 2010

(65) Prior Publication Data

US 2011/0057844 A1 Mar. 10, 2011

(30) Foreign Application Priority Data

Sep. 8, 2009 (JP) ..... 2009-207302

(51) Int. Cl.
*H01Q 1/38* (2006.01)

(52) U.S. Cl.
USPC ..... 343/700 MS; 343/797

(58) Field of Classification Search
USPC ..... 343/700 MS, 767, 702
See application file for complete search history.

(56) References Cited

U.S. PATENT DOCUMENTS

2005/0024281 A1* 2/2005 Apostolos ..... 343/767
2007/0126648 A1* 6/2007 Svensson et al. ..... 343/767

FOREIGN PATENT DOCUMENTS

JP 2006-014272 1/2006

* cited by examiner

*Primary Examiner* — Dieu H Duong
(74) *Attorney, Agent, or Firm* — Antonelli, Terry, Stout & Kraus, LLP.

(57) ABSTRACT

An antenna according to the present invention comprises: a conductor plate with an axisymmetrical shape; a slot formed on the conductor plate; and a feeding point provided on the axisymmetrical axis of the conductor plate, in which the conductor plate is folded along two locations that are parallel to the axisymmetrical axis toward mutually different directions.

5 Claims, 38 Drawing Sheets

| EMBODI-MENT | α | β |
|---|---|---|
| E1 | 115° | 90° |
| E2 | 115° | 115° |
| E3 | 90° | 65° |
| E4 | 90° | 90° |

(a)

(b)

(c)

ANTENNA AND ELECTRONIC DEVICE EQUIPPED WITH SAME

CLAIM OF PRIORITY

The present application claims priority from Japanese patent application serial no. 2009-207302 filed on Sep. 8, 2009, the content of which is hereby incorporated by reference into this application.

BACKGROUND OF THE INVENTION

1. Field of the Invention

The present invention relates to an antenna used for a communication system which transmits and receives radio waves made up of specific polarization components. Specifically, the invention relates to an antenna capable of efficiently transmitting and receiving radio waves on two frequency bands in this communication system and an electronic device equipped with the antenna.

2. Description of Related Art

Recently, a variety of information including position information and road information is provided by the use of GPS (Global Positioning System) and terrestrial digital TV broadcasting via transmissions to vehicles. Also to further improve user-friendly properties and the safety, a large number of wireless communication devices have been developed and put into practical use. In terms of wireless communication with improved safety, emergency communication systems and antennas capable of transmitting and receiving vertically-polarized waves necessary for emergency communication have been developed. This type of antenna is installed on the inclined surface of automobile windshields or the like, and the direction of maximum radiation is oriented in the zenith direction. On the other hand, radio waves transmitted from a base station located at a great distance from a terminal are transmitted in a horizontal direction which is almost parallel to the ground. Therefore, it is necessary to control the antenna's maximum radiation direction so that the direction becomes horizontal to the ground.

For example, JP-A 2006-14272 discloses an example of a conventional technology, which is an antenna device capable of creating a main beam tilting from the vertical direction to the horizontal direction. This antenna is installed in a rearview mirror so that the rearview mirror functions as a reflecting plate, thereby creating a beam tilting from the vertical direction to the horizontal direction with regard to the plane. This antenna is structured such that two identical, horizontally-long slot elements are vertically disposed on one conductor, and a microstrip is connected to a portion slightly displaced from the center of the interval between two slot elements. By doing so, two slot elements are excited to occur a phase difference, and by keeping a certain distance between the antenna and the rearview mirror, the rearview mirror functions as a reflecting plate, and by synthesizing radiation from the two slots and radiation from the reflecting plate, a main beam is formed which is horizontally tilting with respect to the antenna face.

However, in this case, it can be expected that the corresponding operation can respond to one frequency band and cannot respond to two different frequency bands. To allow operation on two different frequency bands while maintaining the effects of tilting the main beam, it is necessary to provide one antenna for each frequency band. Consequently, the size of the entire antenna will, be large. Furthermore, the antenna can be installed in a rearview mirror when operating frequency is 5 GHz, however, since the wavelength is long with respect to lower operating frequency and the antenna must be large. Therefore, it becomes difficult to install the antenna in a rearview mirror, and the effects of the reflecting plate cannot be obtained, as a result, it seems that the effects of tilting the antenna face in the horizontal direction are small.

As stated above, according to the conventional technology, it is difficult to provide a small, simple antenna capable of tilting in the direction of maximum radiation on two different frequency bands.

SUMMARY OF THE INVENTION

Under these circumstances, it is an objective of the present invention to address the above problems and to provide an antenna which is capable of tilting in the direction of maximum radiation on two different frequency bands and can be made small as well as provide an electronic device equipped with the antenna.

According to one aspect of the present invention, an antenna comprises: a conductor plate with an axisymmetrical shape; a slot formed on the conductor plate; and a feeding point provided on an axisymmetrical axis of the conductor plate, in which the conductor plate is folded along two locations that are parallel to the axisymmetrical axis toward mutually different directions.

In the above aspect, the following modifications and changes can be made.

(i) The conductor plate is folded along the two locations which are equally distant from the axisymmetrical axis.

(ii) The slot is made in an axisymmetrical shape and an axisymmetrical axis of the slot matches the axisymmetrical axis of the conductor plate.

(iii) Two of the slots are provided.

(iv) The shape of the two slots is identical and the slot width and/or the slot length are/is different. Hereafter, the length direction is defined to be parallel to the axisymmetrical axis of the conductor plate, and the width direction is defined to be perpendicular to the axisymmetrical axis.

(v) The shapes of those slots are mutually different.

(vi) Those slots are formed in a row on the axisymmetrical axis of the conductor plate.

(vii) At least one of those slots is formed such that it can open to one end of the conductor plate in a direction of the axisymmetrical axis.

(viii) The feeding point is provided only to one of those slots.

(ix) The conductor plate has a horizontally rectangular shape oriented in the direction of the axisymmetrical axis; a composite slot is formed on one part of the axisymmetrical axis of the conductor plate, the composite slot comprising a laterally-facing M-shaped slot and a trapezoid slot with a width gradually becoming larger to an open end and formed in a succession of the laterally-facing M-shaped slot; and a rectangle slot is formed on the other part of the axisymmetrical axis of the conductor plate, thereby a slot boundary conductor portion being formed in the central portion on the axisymmetrical axis of the conductor plate between the composite slot and the rectangle slot.

(x) The rectangle slot comprises an elongated slot having an open end and a square slot formed in a succession of the elongated slot.

(xi) Assuming that $\lambda 1$ is a wavelength of a radio wave at first design frequency $\nu 1$ with respect to two frequency bands used for the composite slot, $2d$ is a width of an upper base of the trapezoid slot, f is a length of the M-shaped slot along the direction of the axisymmetrical axis, and h is a length of each of two sides which connect the upper base and a lower base of the trapezoid slot; d, f, and h are to be adjusted so that a relationship of "d+f+h=λ1/3.7" can be established.

(xii) Assuming that λ2 is a wavelength of a radio wave at second design frequency ν2 with respect to two frequency bands used for the rectangle slot, g is a length of the elongated slot along the direction of the axisymmetrical axis, e is a width of the elongated slot, and b is a width of a side perpendicular to the axisymmetrical axis of the conductor plate; g, e, and b are to be adjusted so that a relationship of "g+(b−e)/2=λ2/3.1" can be established.

(xiii) The feeding point is provided to the rectangle slot.

(xiv) A coaxial cable, a plurality of single-core cables or a flat cable is used for feeding.

(xv) The conductor plate is a conductor flat-plate or a flexible conductor sheet or film. Herein, the word "sheet" includes a film.

(xvi) The conductor flat-plate is made of a copper plate or a springy phosphor-bronze plate.

(xvii) The flexible conductor sheet (film) is made of a copper foil or an aluminum foil.

(xviii) An electronic device is equipped with the above-mentioned antenna.

ADVANTAGES OF THE INVENTION

The present invention has excellent advantages as follows:

(1) It is possible to provide a small, simple antenna capable of efficiently transmitting and receiving radio waves made up of specific polarization components on two different frequency bands and tilting in the direction of maximum radiation, and also to provide an electronic device equipped with the antenna.

(2) It is possible to provide an antenna which is highly flexible with regard to the installation conditions.

DETAILED DESCRIPTION OF THE PREFERRED EMBODIMENTS

Figure 1:
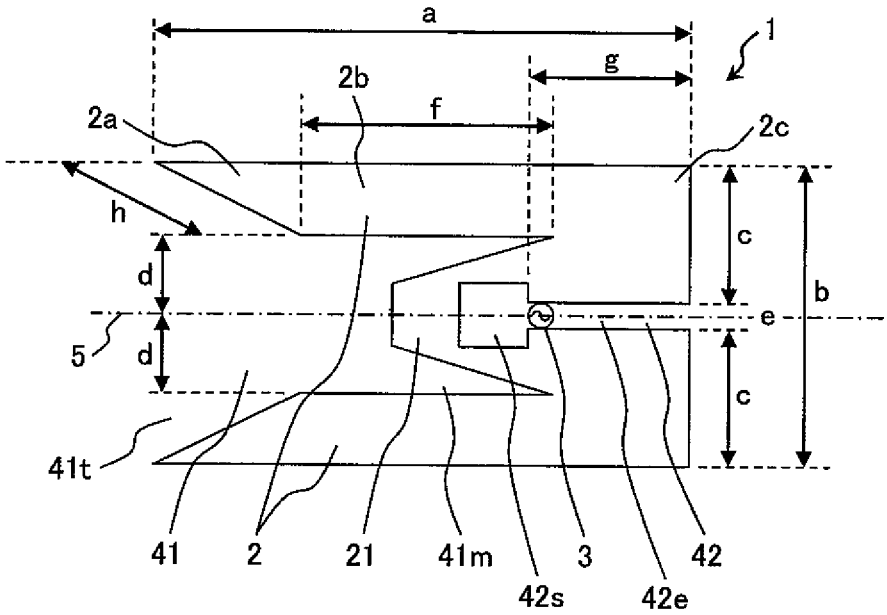
FIG. 1 is a schematic view illustrating a plane view of an antenna structure which is the basis for the present invention.

A preferred embodiment of the present invention will be described below with reference to the attached drawings. However, the present invention is not limited to the embodiment described herein.

An antenna according to the present invention uses two antenna element structures capable of efficiently transmitting and receiving radio waves made up of specific polarization components. In those antenna element structures, a feeding point is provided only to one structure, and the antenna element structures are folded at an equal distance from the axisymmetrical axis passing through the feeding point and the center between the two antenna element structures. And then resonance characteristics between the two different frequency bands are adjusted by adjusting the size of each antenna element structure; by adjusting the position of the feeding point; or by combining both adjustment methods. Thus, it is possible to provide a small antenna capable of transmitting and receiving radio waves made up of specific polarization components on the two different frequency bands and tilting in the direction of maximum radiation. Herein, "two different frequency bands" do not mean that high harmonic on resonance of the lowest frequency band by base operation are used to function as two frequency bands.

The "radio wave made up of specific polarization components" is limited to be either a vertically-polarized wave or a horizontally-polarized wave. The antenna element is based on a known structure which can efficiently transmit and receive radio waves made up of specific polarization components, and the present invention applies such a structure.

The antenna according to the present invention can be built into a housing of an electronic device or installed in a piece of equipment. Besides, when the antenna according to the present invention is built into the housing of an electronic device or is installed in a piece of equipment that uses metal (conductor), as long as the metal (conductor) portion of the housing or of a piece of equipment does not come close to or come in contact with the portion of each of the two antenna element structures contributing to power radiation and the portion of adjusting resonance characteristics, the antenna elements' characteristics for efficiently transmitting and receiving radio waves are not affected.

Furthermore, the antenna according to the present invention can be installed on the surface of the dielectrics molded material such as plastic material of the housing of an electronic device, plate glass, or the like. The antenna according to the present invention has a structure in which resonance characteristics of the antenna elements for transmitting and receiving radio waves are not affected as long as the cabling location of the power feeding cable does not intersect with the nonconductor region of the two antenna elements.

[Basic Structure and Resonance Characteristics of Antenna of Present Invention]

The antenna structure which is the basis for the present invention will be described with reference to FIGS. 1 to 3.

FIG. 1 is a schematic view illustrating a plane view of an antenna structure which is the basis for the present invention. As shown in FIG. 1, an antenna 1 which is the basis for the present invention is structured such that a composite slot 41, made up of a laterally-facing M-shaped slot 41*m* having the width 2*d* with an open end and the length f and a trapezoid slot 41*t* having the upper base 2*d* formed in a succession of the M-shaped slot 41*m* and the lower base b, and a rectangle slot 42 also having an open end are provided on the conductor flat-plate 2 having the length a in the lengthwise direction (horizontal direction in the drawing) and the width b in the widthwise direction (vertical direction in the drawing). Thereby, a slot boundary conductor portion 21 having the width 2*d* and functioning as a boundary is formed between the composite slot 41 and the rectangle slot 42. Furthermore, the antenna 1 has an axisymmetrical shape with an axisymmetrical axis 5 passing through the center of the width of each slot 41,42 (also, center of the slot boundary conductor portion 21 in the widthwise direction) and the center of the width b of the conductor flat-plate 2.

The conductor flat-plate 2 is made of, e.g., a copper plate or a springy phosphor-bronze plate. An acute angle conductor portion 2*a* is formed both above and below the trapezoid slot 41*t* as shown in the drawing, and a horizontally-long conductor portion 2*b* is formed both above and below the M-shaped slot 41*m* as shown in the drawing.

The rectangle slot 42 is made up of an elongated slot 42*e* having the width e with an open end and the length g, and a square slot 42*s* formed in a succession of the elongated slot 42*e*. A rectangle conductor portion 2*c* is formed both above and below the elongated slot 42*e* as shown in the drawing. The square slot 42*s* is located near the central portion of the M-shaped slot 41*m*. Both the composite slot 41 and the rectangle slot 42 have axisymmetrical shapes, and each axisymmetrical axis matches the axisymmetrical axis 5 of the antenna 1.

Assuming that with regard to two operating frequency bands, $\lambda 1$ is the wavelength of the radio wave in a first design frequency $\nu 1$ and $\lambda 2$ is the wavelength of the radio wave in the second design frequency $\nu 2$, "d+f+h" is approximately "$\lambda 1/3.7$" and "g+c" (c=(b−e)/2) is approximately "$\lambda 2/3.1$". A feeding point 3 for supplying power to the antenna 1 is located to the rectangle slot 42, and the feeding point 3 is located at a point that is the length g from the open end of the rectangle slot 42.

Herein, when an antenna according to the present invention is built into a device's housing or installed in a piece of equipment, the two operating frequency bands are determined according to the material of the dielectrics which constitutes the device's housing or the equipment as well as the arrangement of surrounding objects. When an antenna according to the present invention is installed on the surface of dielectrics molded material, the two operating frequency bands are determined according to a distance between the antenna and surrounding objects, the arrangement of the surrounding objects, and the shortening effects of wavelength that the dielectrics have.

Figure 2:
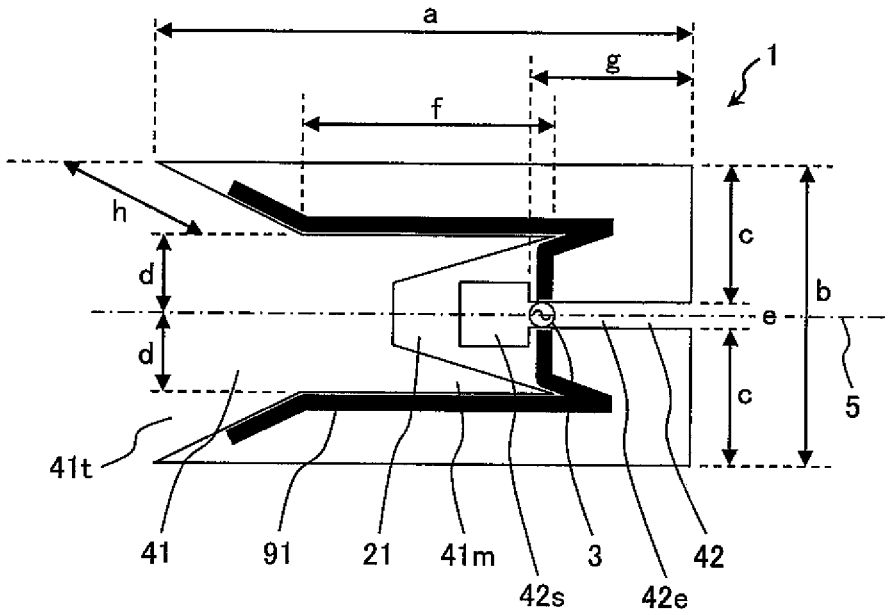
FIG. 2 is a schematic view illustrating current distribution for explaining the operating principle of the antenna described in FIG. 1.

FIG. 2 is a schematic view illustrating current distribution for explaining the operating principle of the antenna described in FIG. 1. In the case of design frequency ν1 which defines wavelength λ1, current having this frequency component and running from the feeding point 3 through the conductor flat-plate 2 that constitutes the antenna 1 is generated as shown in the current distribution 91 in FIG. 2 when the current distributes in association with the resonance operation near the periphery of the conductor opposite to the composite slot 41 having approximately "λ1/3.7" of "d+f+h". Therefore, it is possible to realize a slot antenna which operates at design frequency ν1.

Figure 3:
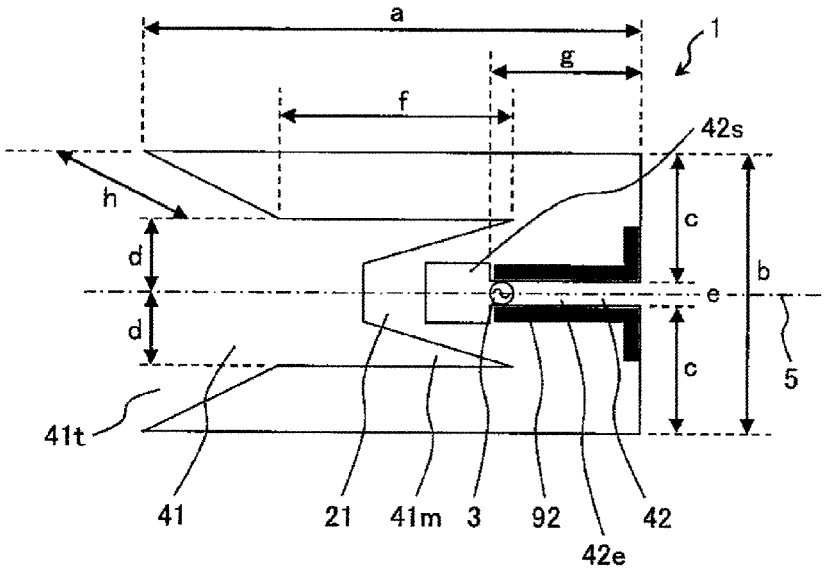
FIG. 3 is another schematic view illustrating current distribution for explaining the operating principle of the antenna described in FIG. 1.

FIG. 3 is another schematic view illustrating current distribution for explaining the operating principle of the antenna described in FIG. 1. On the other hand, in the case of design frequency ν2 which defines wavelength λ2, current having this frequency component and running from the feeding point 3 through the conductor flat-plate 2 that constitutes the antenna 1 is generated as shown in the current distribution 92 in FIG. 3 when the current distributes in association with the resonance operation near the periphery of the conductor opposite to the rectangle slot 42 having approximately "λ2/3.1" of "g+c". Therefore, it is possible to realize a slot antenna which operates at design frequency ν2.

As stated above, in the antenna 1 which is the basis for the present invention, two slot antennas that operate at design frequency ν1 and design frequency ν2 with the feeding point 3 functioning as a boundary can be arranged in a row on the same plane. Therefore, the antenna 1 which is the basis for the present invention enables radio waves made up of specific polarization components in two frequency bands to be transmitted and received.

Hereafter, resonance characteristics of the antenna 1 which is the basis for the present invention will be explained with reference to FIGS. 4 to 9.

Figure 4:
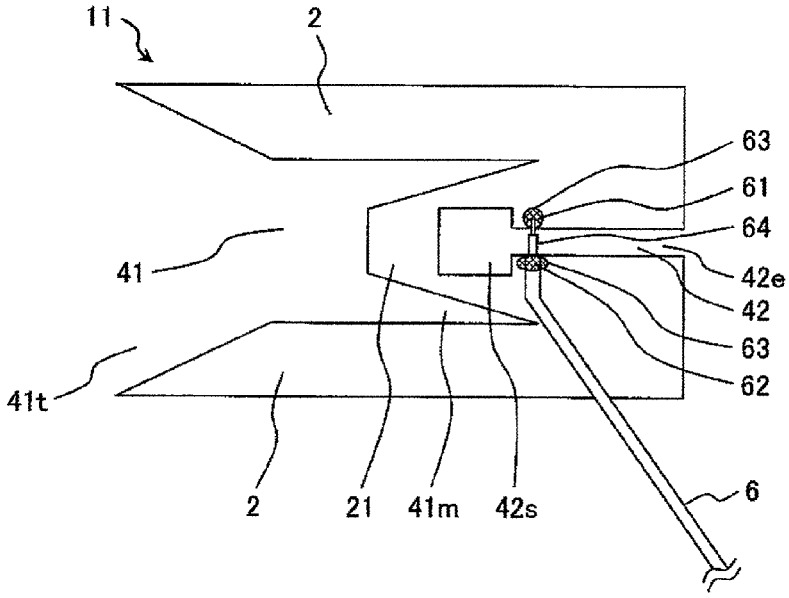
FIG. 4 is a schematic view illustrating a plane view of an exemplary antenna according to the present invention.

FIG. 4 is a schematic view illustrating a plane view of an exemplary antenna according to the present invention. As shown in FIG. 4, an antenna 11 is one that a coaxial cable 6 for feeding power is connected to the feeding point 3 of the antenna 1 in FIG. 1. In the antenna 11, an inner conductor 61 of the coaxial cable 6 is connected by conductive solder material 63 to one of the conductor's peripheries opposite to each other in parallel along the length of the rectangle slot 42 and an outer conductor 62 of the coaxial cable 6 is connected by a conductive solder material 63 to the other periphery. An insulating body 64 which is an intermediate layer between the inner conductor 61 and the outer conductor 62 of the coaxial cable 6 can be an insulation resin or a hollow space that uses air as a means of insulation. For the connection of a power feeding cable, such as a coaxial cable, or the like, a specialized connector or stay in a shape that can maintain conductivity can be used in addition to fusion splicing using conductive solder material.

The antenna 11 in FIG. 4 is made of a 0.2 mm thick conductor flat-plate and its dimensions are a=102 mm, b=50 mm, c=24 mm, d=10 mm, e=2 mm, f=45 mm, g=26 mm, and h=41 mm based on the definition in FIG. 1. In order to have the antenna 11 operate on two frequency bands of 800 and 1900 MHz, "d+f+h" is to be approximately 1/3.7 of the wavelength of the radio wave λ1 (approximately equal to 349 mm) at the first design frequency of 860 MHz, and "g+c" is to be approximately 1/3.1 of the wavelength of the radio wave λ2 (approximately equal to 156 mm) at the second design frequency of 1920 MHz.

Furthermore, the coaxial cable 6 having a diameter of approximately 1.1 mm is used for supplying power to the antenna 11, and ferrite is attached to portions which do not overlap the conductor portion of the antenna 11 by considering the effects on various characteristics. Moreover, ferrite is also attached in the same manner to the coaxial cable used in the following description of the antenna according to the present invention.

Figure 5:
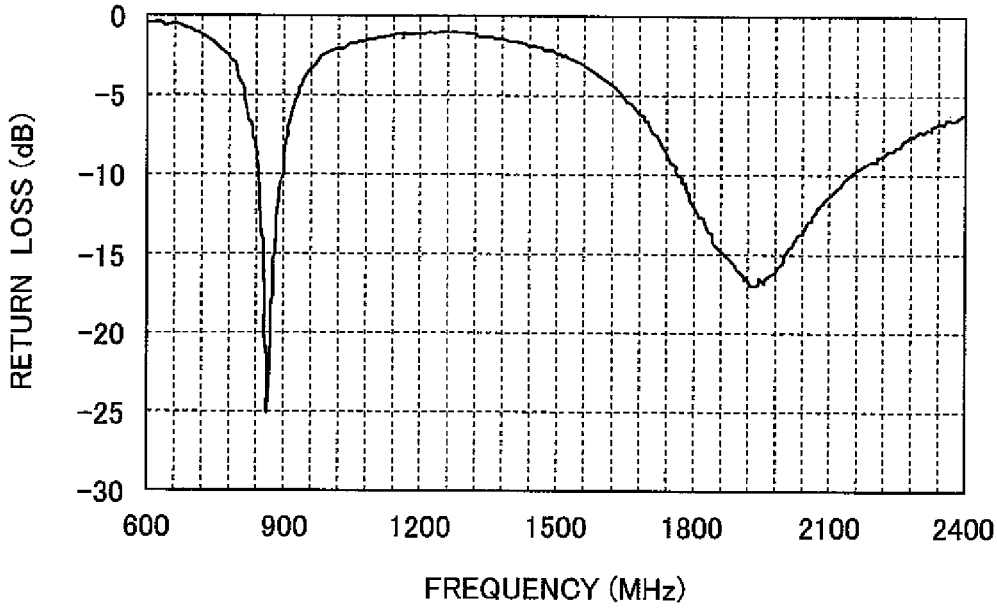
FIG. 5 is a graph showing a relationship between return loss and frequency in the antenna of FIG. 4.

FIG. 5 is a graph showing a relationship between return loss and frequency in the antenna of FIG. 4. In FIG. 5, the frequency is plotted on the horizontal axis and the return loss is plotted on the vertical axis. FIG. 5 shows that the antenna 11 operated on two frequency bands of 800 and 1900 MHz.

Figure 6:
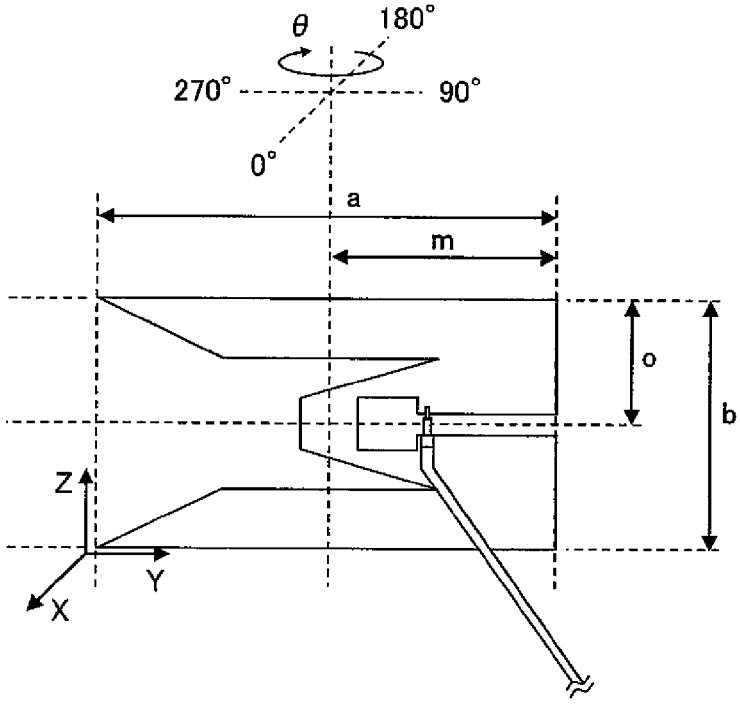
FIG. 6 is a schematic view illustrating a definition of measuring XY-plane on which directivity in the far-field of an antenna is measured.

FIG. 6 is a schematic view illustrating a definition of measuring XY-plane on which directivity in the far-field of an antenna is measured. In FIG. 6, the antenna 11 of FIG. 4 is described. The center of the measuring XY-plane is defined at a location which satisfies length m that is half of length a in the horizontal direction of the antenna and width o that is half of width b in the vertical direction of the antenna. The center of the measuring XY-plane in the following description of the antenna according to the present invention is to be defined in the same manner as the above.

Figure 7:
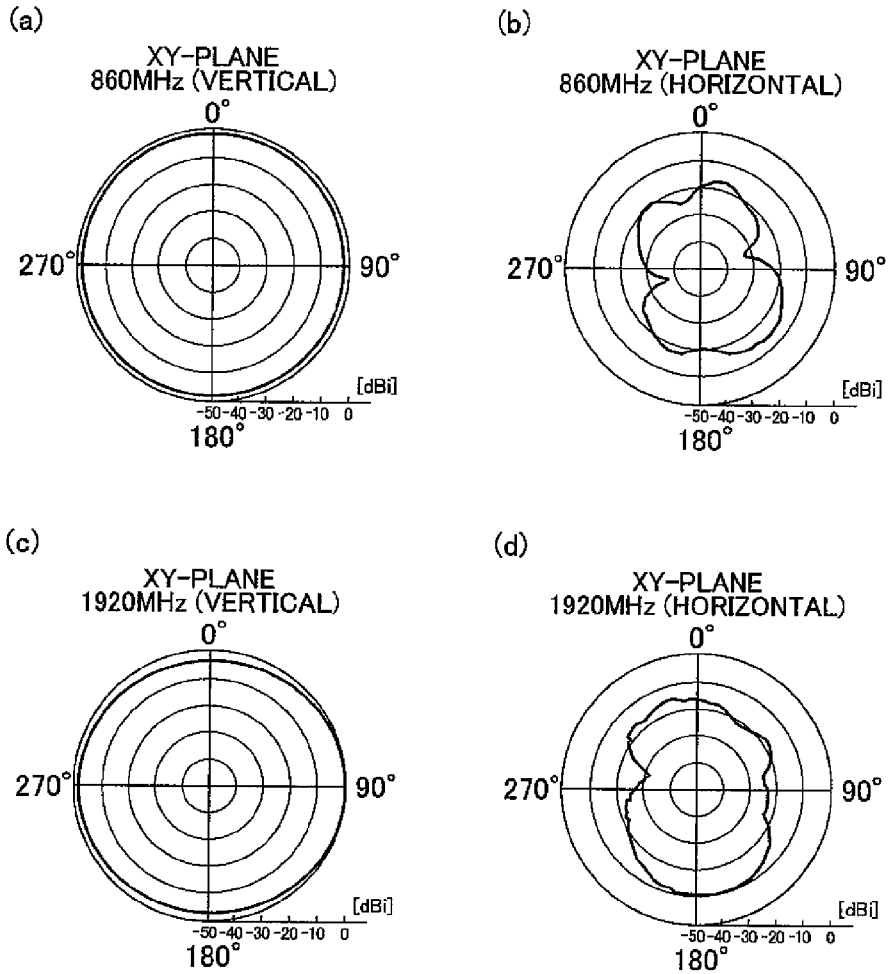
FIG. 7 illustrates measurement results of directivity of the antenna measured on the measuring XY-plane in FIG. 6 in four categories: two frequency bands, a vertically-polarized wave (Vertical) and a horizontally-polarized wave (Horizontal).

FIG. 7 illustrates measurement results of directivity of the antenna measured on the measuring XY-plane in FIG. 6 in four categories: two frequency bands, a vertically-polarized wave (Vertical) and a horizontally-polarized wave (Horizontal). As shown in FIG. 7, at each frequency on the two frequency bands, good nondirectivity resulting from a vertically-polarized wave could be obtained.

Figure 8:
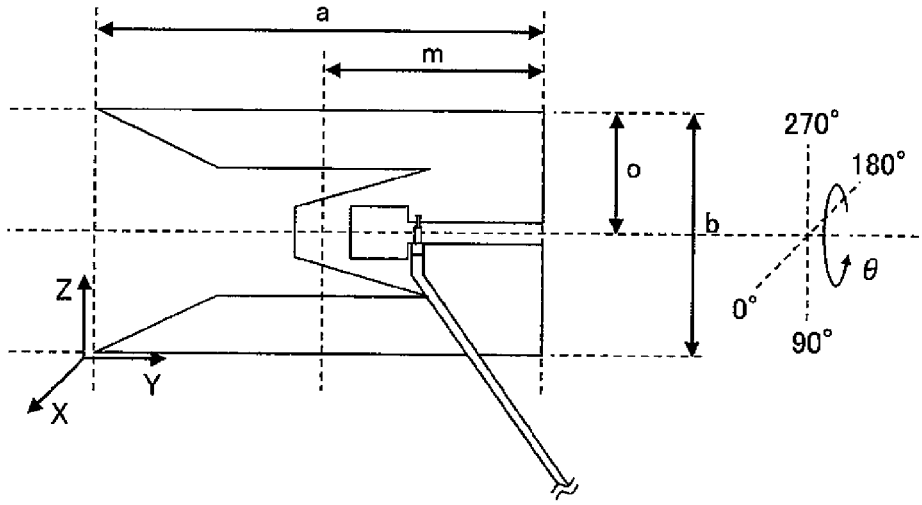
FIG. 8 is a schematic view illustrating a definition of measuring XZ-plane on which directivity in the far-field of an antenna is measured.

FIG. 8 is a schematic view illustrating a definition of measuring XZ-plane on which directivity in the far-field of an antenna is measured. In FIG. 8, the antenna 11 of FIG. 4 is described. The center of the measuring XZ-plane is also defined at a location which satisfies length m that is half of length a in the horizontal direction of the antenna and width o that is half of width b in the vertical direction of the antenna. The center of the measuring XZ-plane in the following description of the antenna according to the present invention is to be defined in the same manner as the above.

Figure 9:
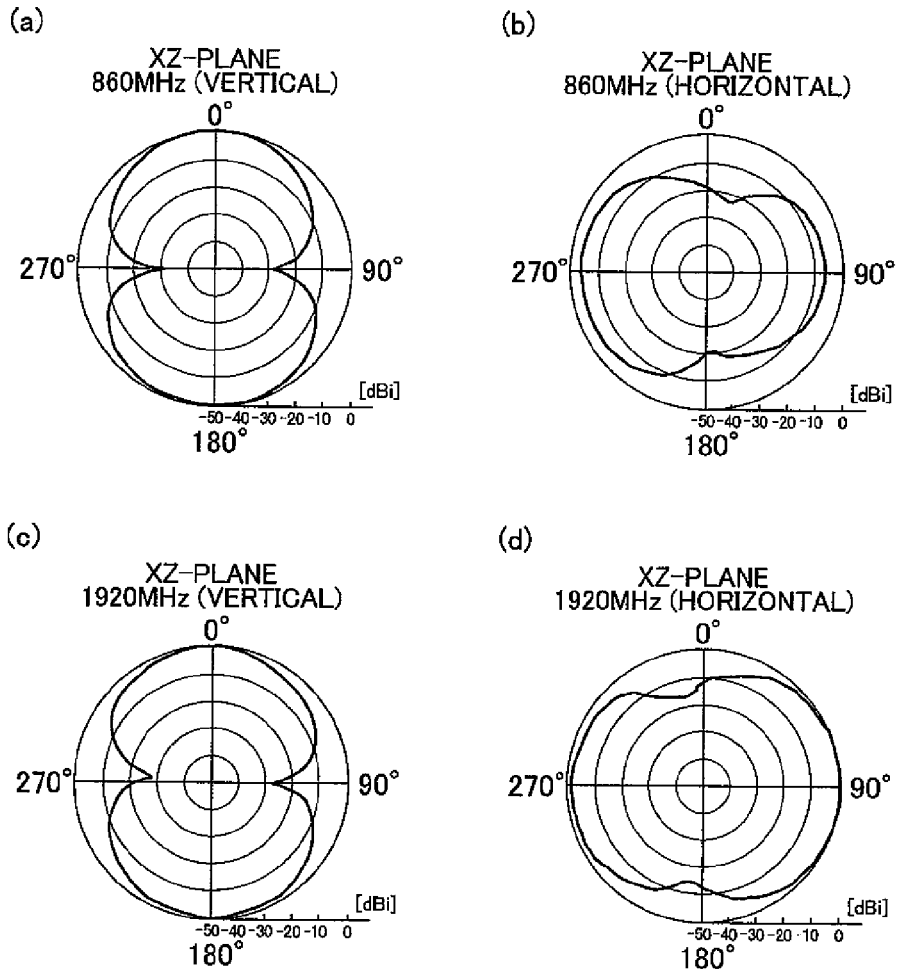
FIG. 9 illustrates measurement results of directivity of the antenna measured on the measuring XZ-plane in FIG. 8 in four categories: two frequency bands, a vertically-polarized wave (Vertical) and a horizontally-polarized wave (Horizontal).

FIG. 9 illustrates measurement results of directivity of the antenna measured on the measuring XZ-plane in FIG. 8 in four categories: two frequency bands, a vertically-polarized wave (Vertical) and a horizontally-polarized wave (Horizontal). As shown in FIG. 9, at each frequency on the two frequency bands, a vertically-polarized wave with figure-eight directivity could be obtained.

When the antenna 11 in FIG. 4 is installed on an inclined surface such as an automobile's windshield, in order to have the direction of maximum radiation of the figure-eight directivity face the horizontal direction, it is necessary in some cases to tilt the direction of maximum radiation of the figure-eight directivity from the vertical, direction of the installed surface (0° and 180° directions in FIG. 9) to the horizontal direction (90° and 270° directions in FIG. 9). Specifically, with regard to automobiles, such as trucks, in which the inclination of windshield is nearly 90° to the ground, it is not necessary to tilt the direction of maximum radiation because the direction of maximum radiation of the vertically-polarized wave on the XZ-plane faces the horizontal direction when the antenna is installed on the windshield. However, with regard to automobiles, such as sports cars, in which the inclination of windshield is nearly 0° to the ground, it is necessary to significantly tilt the direction of maximum radiation to the horizontal direction because the direction of maximum radiation of the vertically-polarized wave on the XZ-plane faces the vertical direction when the antenna is installed on the windshield.

First Embodiment of Present Invention

Hereafter, a first embodiment of the present invention which is intended to solve the problem with tilting the direction of maximum radiation will be explained with reference to FIGS. 10 to 21.

Figure 10:
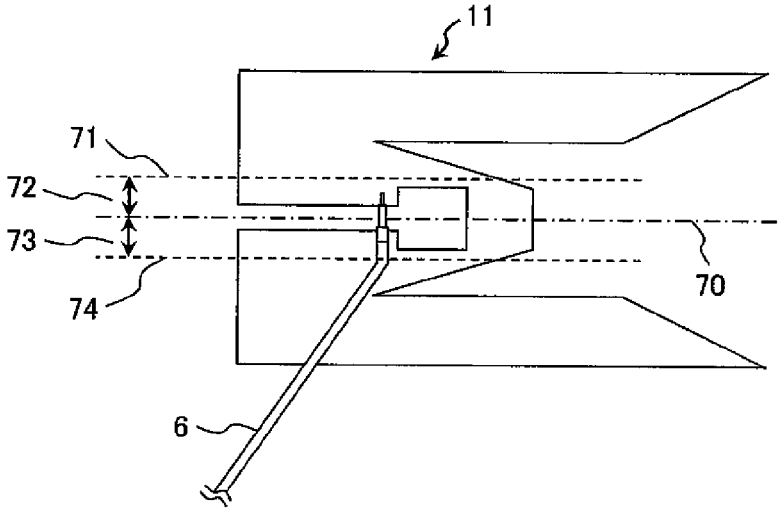
FIG. 10 is a schematic view illustrating a plane view of an antenna according to the present invention, being indicated a folding position to tilt the direction of maximum radiation of the antenna in FIG. 4.

FIG. 10 is a schematic view illustrating a plane view of an antenna according to the present invention, being indicated folding positions to tilt the direction of maximum radiation of the antenna in FIG. 4. The upper and lower folding positions 71,74 are located at equal intervals 72,73 (6 mm in this embodiment) from the axisymmetrical axis 70 of the antenna 11.

Figure 11:
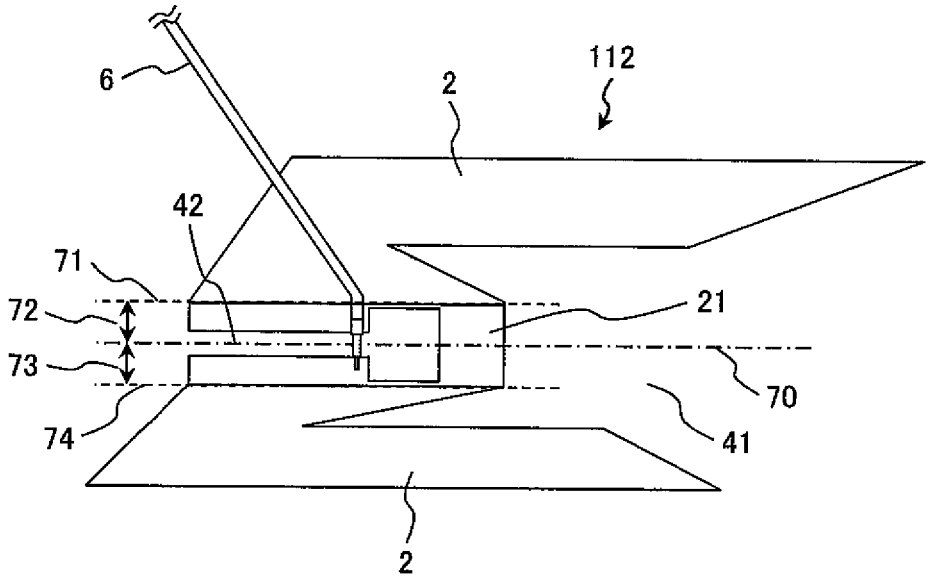
FIG. 11 is a schematic view illustrating a perspective view of an antenna according to a first embodiment of the present invention.

FIG. 11 is a schematic view illustrating a perspective view of an antenna according to a first embodiment of the present invention. As shown in FIG. 11, an antenna 112 is folded along the upper and lower folding positions 71,74 which are parallel to the axisymmetrical axis 70 with certain intervals toward mutually different directions. That is, in FIG. 11, the upper part of the antenna 112 located above the folding position 71 is folded backward in the drawing, and the lower part of the antenna 112 located below the folding position 74 is folded forward in the drawing.

Figure 12:
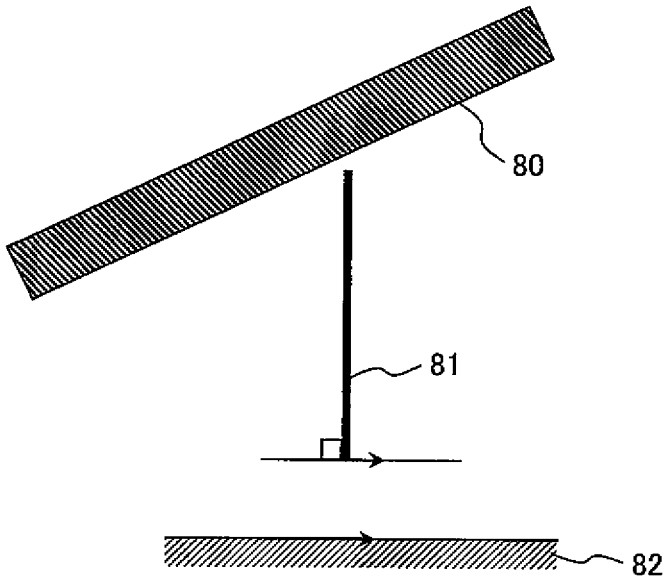
FIG. 12 is a schematic view illustrating a side view of an antenna for explaining arrangement of the antenna.

FIG. 12 is a schematic view illustrating a side view of an antenna for explaining arrangement of the antenna. The antenna 81 is a side view of the antenna 11 in FIG. 10. FIG. 12 shows the arrangement in which the antenna 81 is disposed under the windshield 80 having an inclination of 25° so that the antenna 81 becomes perpendicular to the ground 82. If the arrangement shown in FIG. 12 is possible, it is not necessary to tilt the direction of maximum radiation of the antenna 81. However, in the arrangement shown in FIG. 12, the projecting portion from the windshield (antenna installation surface) is very large, therefore, it is necessary to consider a different arrangement.

Figure 13:
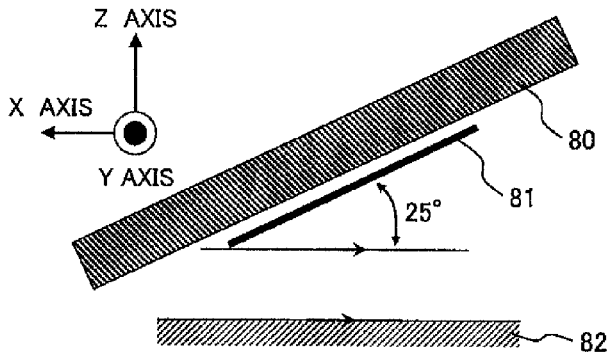
FIG. 13 is another schematic view illustrating a side view of the antenna for explaining arrangement of the antenna.

FIG. 13 is another schematic view illustrating a side view of the antenna for explaining arrangement of the antenna. FIG. 13 shows the arrangement in which the antenna 81 is disposed under the windshield 80 having an inclination of 25° so that the antenna 81 becomes parallel to the windshield 80. With the arrangement shown in FIG. 13, unlike the arrangement shown in FIG. 12, the portion projecting from the windshield (antenna installation surface) can be made small. However, in the case of FIG. 13, since the antenna 81 is disposed so that it becomes parallel to the windshield having an inclination of 25°, the direction of maximum radiation of the antenna 81 is oriented at an elevation angle of 65°. Therefore, it is necessary to tilt the direction of maximum radiation (elevation angle of 65°) of the antenna 81 to the horizontal direction (elevation angle of 0°).

Figure 14:
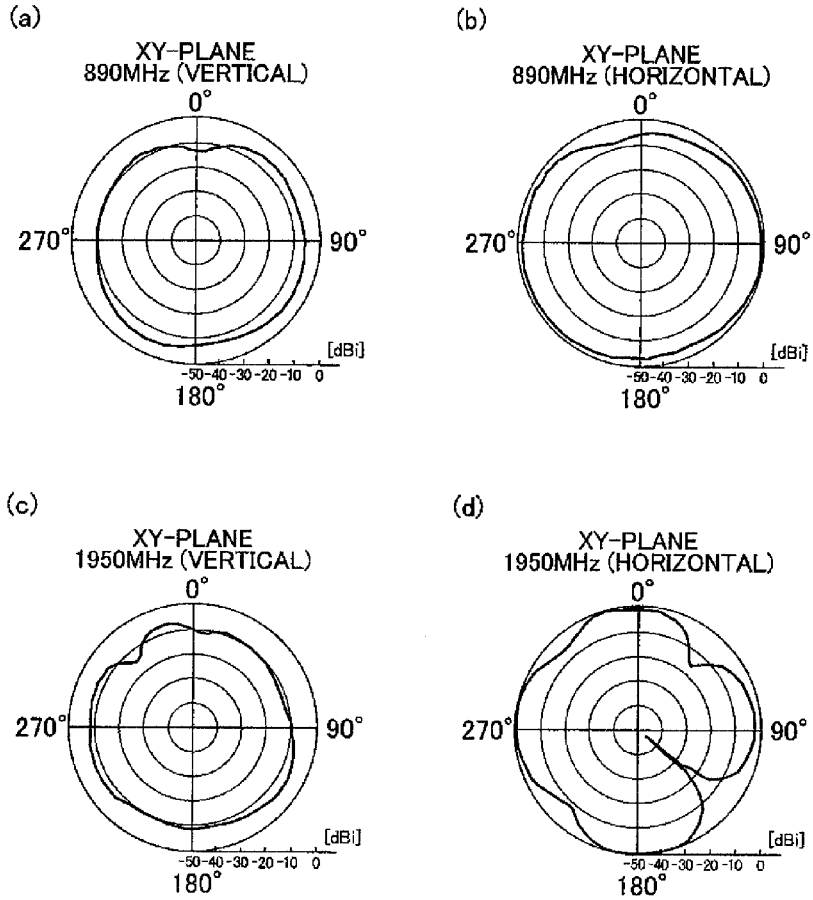
FIG. 14 illustrates measurement results of directivity of the antenna in the arrangement shown in FIG. 13 by measuring on the XY-plane in four categories: two frequency bands, a vertically-polarized wave (Vertical) and a horizontally-polarized wave (Horizontal).

FIG. 14 illustrates measurement results of directivity of the antenna in the arrangement shown in FIG. 13 by measuring on the XY-plane in four categories: two frequency bands, a vertically-polarized wave (Vertical) and a horizontally-polarized wave (Horizontal). As shown in FIG. 14, at each frequency on the two frequency bands, nondirectivity resulting from a vertically-polarized wave could be obtained. However, in comparison with the characteristics (measurement results) shown in FIG. 7 when an inclination is 90°, the horizontally-polarized wave significantly increased and the vertically-polarized wave decreased. This is because the direction of maximum radiation of the antenna has changed from the horizontal direction to the zenith direction by tilting the antenna face at an inclination of 25°.

Figure 15:
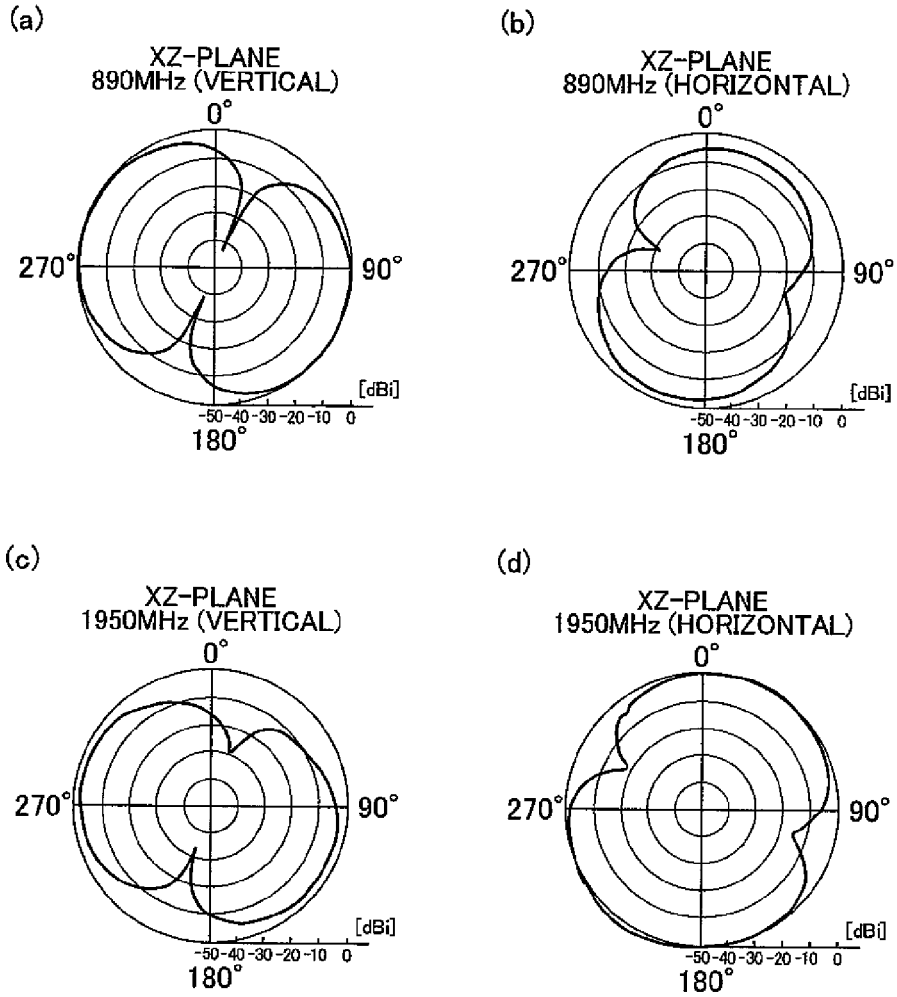
FIG. 15 illustrates measurement results of directivity of the antenna in the arrangement shown in FIG. 13 by measuring on the XZ-plane in four categories: two frequency bands, a vertically-polarized wave (Vertical) and a horizontally-polarized wave (Horizontal).

FIG. 15 illustrates measurement results of directivity of the antenna in the arrangement shown in FIG. 13 by measuring on the XZ-plane in four categories: two frequency bands, a vertically-polarized wave (Vertical) and a horizontally-polarized wave (Horizontal). As shown in FIG. 15, at each frequency on the two frequency bands, a vertically-polarized wave with figure-eight directivity could be obtained. However, in comparison with the characteristics (measurement results) shown in FIG. 9 when an inclination is 90°, the direction of maximum radiation of the figure-eight directivity changed at 65°. This is also because the direction of maximum radiation of the antenna has changed from the horizontal direction to the zenith direction by tilting the antenna face at an inclination of 25°.

Figure 16:
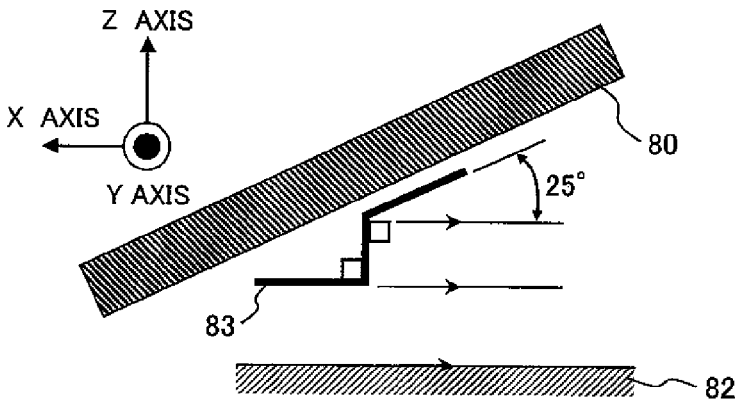
FIG. 16 is a schematic view illustrating a side view of an antenna according to a first embodiment of the present invention for explaining arrangement of the antenna.

FIG. 16 is a schematic view illustrating a side view of an antenna according to a first embodiment of the present invention for explaining arrangement of the antenna. The antenna 83 is a side view of the antenna 112 in FIG. 11. FIG. 12 shows the arrangement in which the antenna 83 is disposed under the windshield 80 having an inclination of 25°.

Figure 17:
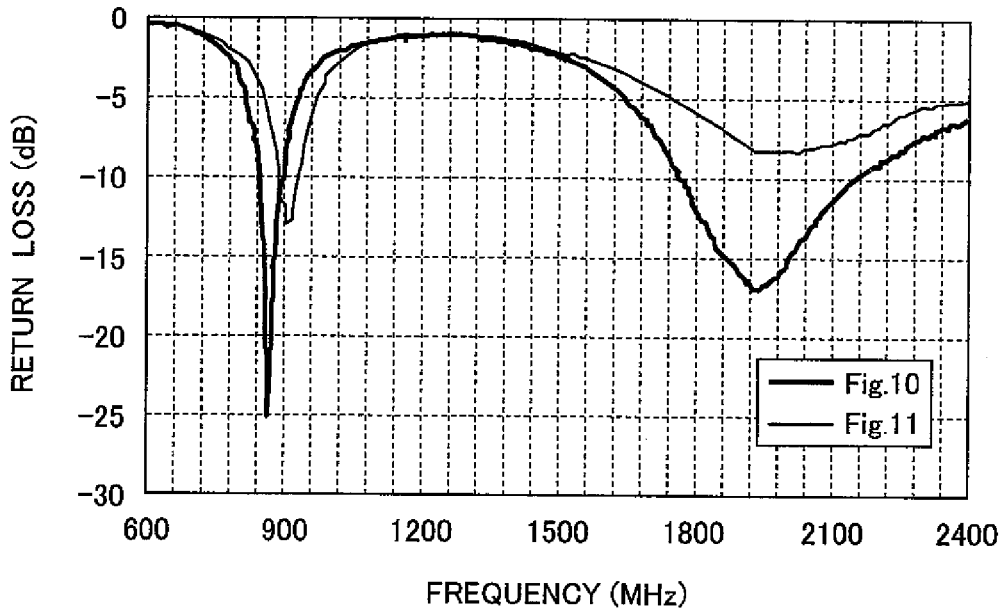
FIG. 17 is a graph showing a relationship between return loss and frequency in the antenna of FIG. 11 according to a first embodiment of the present invention.

FIG. 17 is a graph showing a relationship between return loss and frequency in the antenna of FIG. 11 according to a first embodiment of the present invention. In FIG. 17, the frequency is plotted on the horizontal axis and the return loss is plotted on the vertical axis. The results of the antenna 11 of FIG. 10 are also shown in FIG. 17 by a thick line. As shown in FIG. 17, the antenna 112 of FIG. 11 exhibited the resonance characteristics on two frequency bands: 800 MHz on which operation mainly occurred in the composite slot 41 with no feeding point provided; and 1900 MHz on which operation mainly occurred in the rectangle slot 42 with a feeding point provided. In comparison with the results of the antenna 11 in FIG. 10, as the result of folding the antenna, the upper and the lower conductor flat-plates came closer together causing characteristics to deteriorate along with mismatching of impedance, however, the desired resonance characteristics on two frequency bands were substantially realized.

Figure 18:
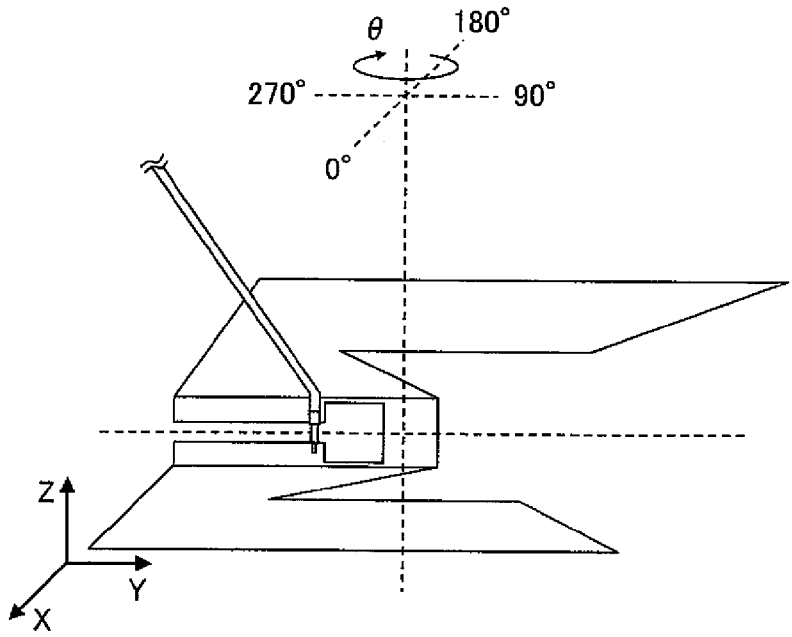
FIG. 18 is a schematic view illustrating a definition of measuring XY-plane on which is measured directivity in the far-field of the antenna of FIG. 11 according to a first embodiment of the present invention.
Figure 19:
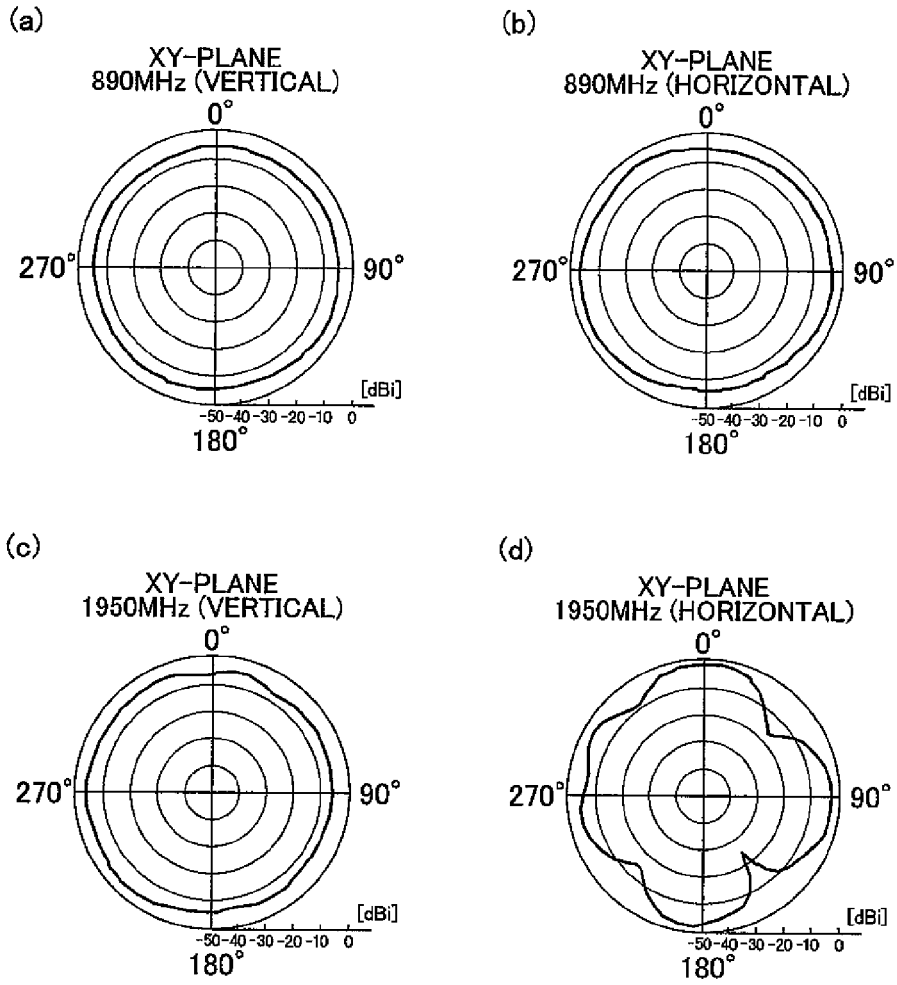
FIG. 19 illustrates measurement results of directivity of the antenna according to a first embodiment of the present invention by measuring on the XY-plane in FIG. 18 in four categories: two frequency bands, a vertically-polarized wave (Vertical) and a horizontally-polarized wave (Horizontal).

FIG. 18 is a schematic view illustrating a definition of measuring XY-plane on which is measured directivity in the far-field of the antenna of FIG. 11 according to a first embodiment of the present invention. FIG. 19 illustrates measurement results of directivity of the antenna according to a first embodiment of the present invention by measuring on the XY-plane in FIG. 18 in four categories: two frequency bands, a vertically-polarized wave (Vertical) and a horizontally-polarized wave (Horizontal). As shown in FIG. 19, at each frequency on the two frequency bands, nondirectivity resulting from a vertically-polarized wave could be obtained. However, in comparison with the characteristics obtained on the XY-plane shown in FIG. 7, the horizontally-polarized wave significantly increased and the vertically-polarized wave slightly decreased. This is because the distance between the upper and the lower conductors became small as the result of folding the antenna, and current generated in the vertical direction on the plane has changed to current generated in the horizontal direction.

In the present invention, in order to strictly define the direction of maximum radiation, the intermediate direction of the half-power width (angle width between points 3 dB lower than the maximum value of a main lobe of the directivity) is defined as the direction of maximum radiation. In this description of an antenna according to the present invention, the direction of maximum radiation is defined in the same manner.

To evaluate the direction of maximum radiation of the figure-eight directivity, the inventors have compared and studied three kinds of evaluation methods: the intermediate direction of the half-power width; intermediate direction of two nulls (direction of minimum directivity); and the direction of a maximum value of two main lobes. As a result, the intermediate direction of the half-power width and the intermediate direction of two nulls were almost identical, however, the direction of a maximum value of two main lobes was significantly different from the other two evaluation methods. Furthermore, a radiation direction evaluation method using a half-power width is commonly known. Therefore, the present invention evaluates the intermediate direction of the half-power width as a direction of maximum radiation. Moreover, the present invention measures the directivity at the resonance peak in the frequency characteristics and evaluates the direction of maximum radiation.

Figure 20:
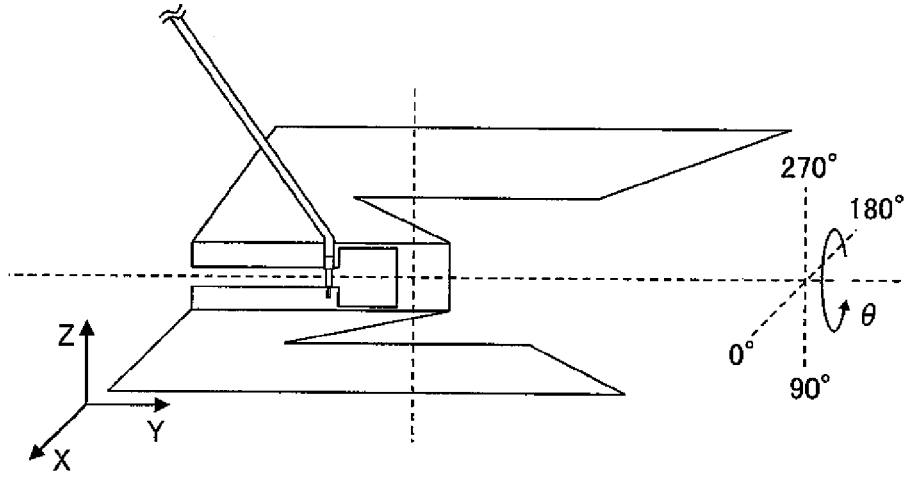
FIG. 20 is a schematic view illustrating a definition of measuring XZ-plane on which is measured directivity in the far-field of the antenna of FIG. 11 according to a first embodiment of the present invention.
Figure 21:
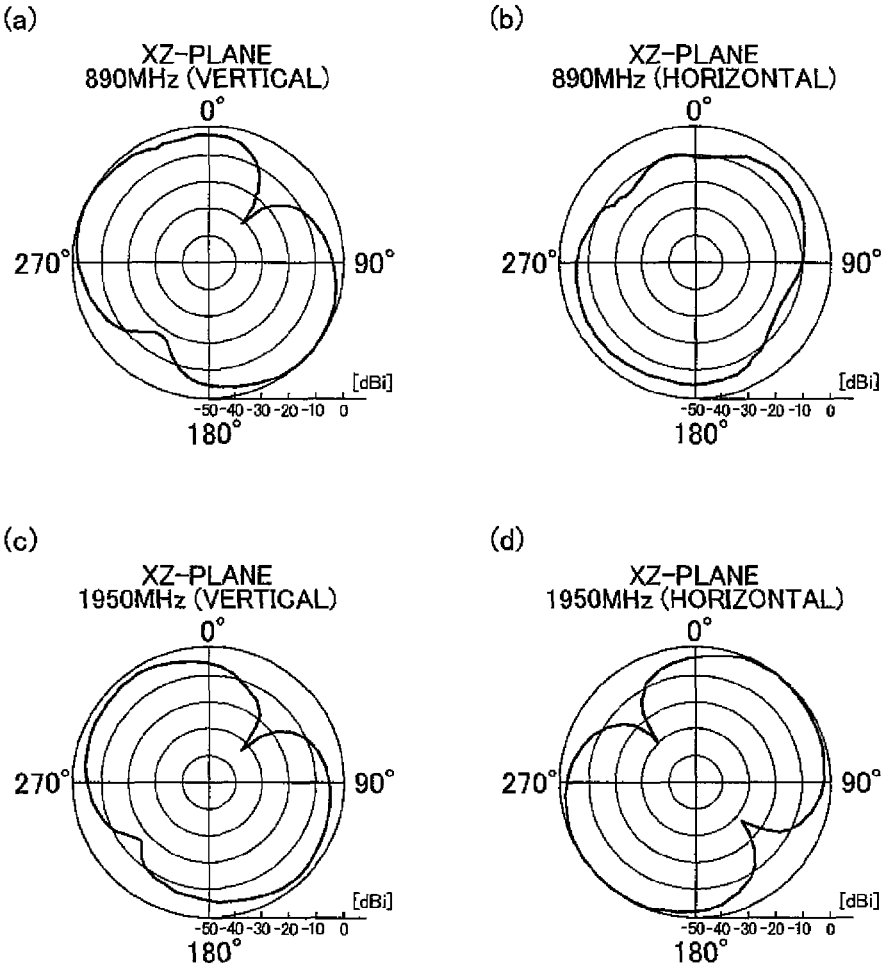
FIG. 21 illustrates measurement results of directivity of the antenna according to a first embodiment of the present invention by measuring on the XZ-plane in FIG. 20 in four categories: two frequency bands, a vertically-polarized wave (Vertical) and a horizontally-polarized wave (Horizontal).

FIG. 20 is a schematic view illustrating a definition of measuring XZ-plane on which is measured directivity in the far-field of the antenna of FIG. 11 according to a first embodiment of the present invention. FIG. 21 illustrates measurement results of directivity of the antenna according to a first embodiment of the present invention by measuring on the XZ-plane in FIG. 20 in four categories: two frequency bands, a vertically-polarized wave (Vertical) and a horizontally-polarized wave (Horizontal). As shown in FIG. 21, at each frequency on the two frequency bands, a vertically-polarized wave with figure-eight directivity could be obtained.

However, it is necessary to tilt the direction of maximum radiation, which is the intermediate direction of the half-power width of the figure-eight directivity, from the perpendicular direction (295° and 115° directions in FIG. 21) to the installation surface of the windshield 80 having an inclination of 25° toward the horizontal direction (0° and 180° directions in FIG. 21). When the front direction is 0° and the rear direction is 180°, the direction of maximum radiation on two frequency bands shown in FIGS. 21(*a*) and 21(*c*) is oriented at elevation angles (angle between the 0° direction and the direction of maximum radiation) of 61° and 47° at the front and at depression angles (angle between the 180° direction and the direction of maximum radiation) of 51° and 52° at the rear at 890 and 1950 MHz, respectively. This means that as the result of folding the antenna toward the front and rear directions as shown in FIG. 11 (the side view is described in FIG. 16), when compared to the plane shown in FIG. 10 (the side view is described in FIG. 13), the direction of maximum radiation tilts by 4° and 18° in the horizontal direction at the front and by 14° and 13° in the horizontal direction at the rear. This is because the main electric field generating surface formed by connecting points, by straight lines, farthest from the feeding points in current distributions 91, 92 shown in FIGS. 2 and 3 came close to a perpendicular angle to the ground 82 when compared to the plane (FIG. 13).

As the results shown in FIG. 21 indicate, in the antenna 112 according to the first embodiment of the present invention, it is possible to provide an antenna capable of transmitting and receiving radio waves made up of specific polarization components on two different frequency bands in the direction closer to the horizontal direction than a direction on the plane. This is made possible by using two antenna element structures capable of efficiently transmitting and receiving radio waves made up of specific polarization components, in which: a feeding point is provided in only one of the two antenna element structures; and the structures are folded along two locations equally distant from the axisymmetrical axis, thereby tilting the direction of maximum radiation on two different frequency bands.

Second Embodiment of Present Invention

Next, a second embodiment of the present invention will be described with reference to FIGS. 22 to 28.

Figure 22:
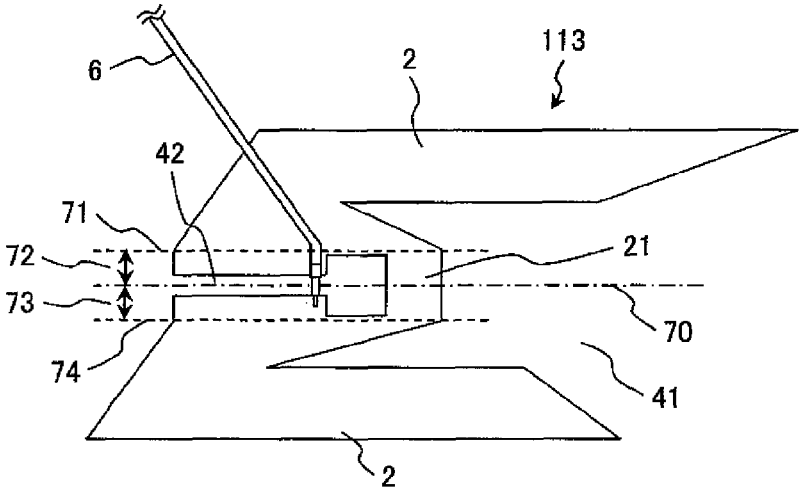
FIG. 22 is a schematic view illustrating a perspective view of an antenna according to a second embodiment of the present invention.

FIG. 22 is a schematic view illustrating a perspective view of an antenna according to a second embodiment of the present invention. As shown in FIG. 22, an antenna 113 is folded along the folding positions which are parallel to the axisymmetrical axis 70 with certain intervals (6 mm both upward and downward from the axisymmetrical axis 70 in this embodiment) toward mutually different directions.

Figure 23:
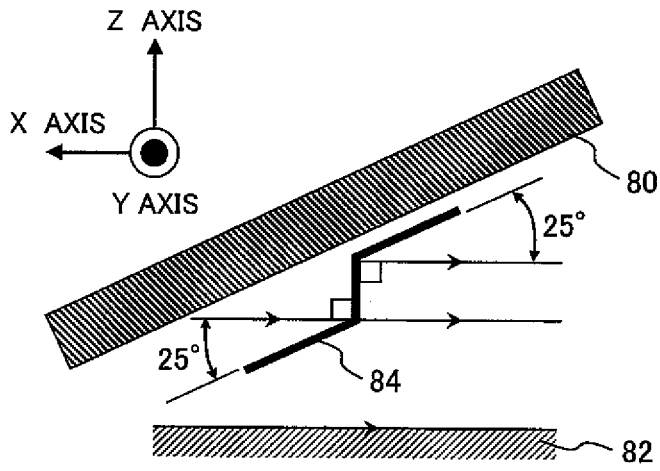
FIG. 23 is a schematic view illustrating a side view of an antenna according to a second embodiment of the present invention for explaining arrangement of the antenna.

FIG. 23 is a schematic view illustrating a side view of an antenna according to a second embodiment of the present invention for explaining arrangement of the antenna. The antenna 84 is a side view of the antenna 113 in FIG. 22 and is disposed under the windshield 80 having an inclination of 25°. There is a difference in the folding angle between the antenna 84 of the second embodiment and one 83 of the first embodiment.

Figure 24:
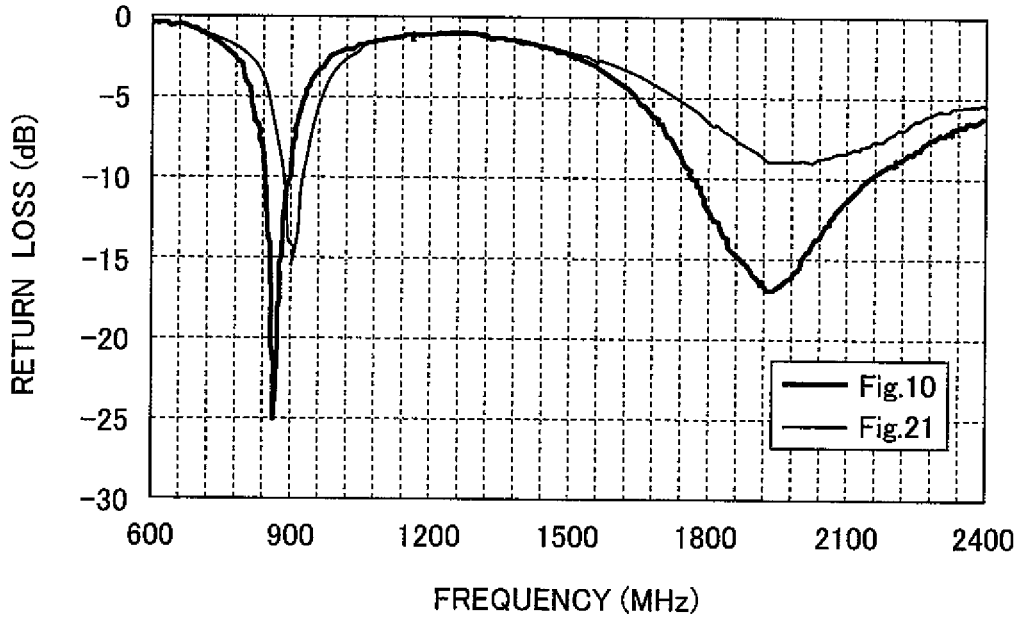
FIG. 24 is a graph showing a relationship between return loss and frequency in the antenna of FIG. 22 according to a second embodiment of the present invention.

FIG. 24 is a graph showing a relationship between return loss and frequency in the antenna of FIG. 22 according to a second embodiment of the present invention. In FIG. 24, the frequency is plotted on the horizontal axis and the return loss is plotted on the vertical axis. The results of the antenna 11 of FIG. 10 are also shown in FIG. 24 by a thick line. As shown in FIG. 24, the antenna 113 of FIG. 22 exhibited the resonance characteristics on two frequency bands: 800 MHz on which operation mainly occurred in the composite slot 41 with no feeding point provided; and 1900 MHz on which operation mainly occurred in the rectangle slot 42 with a feeding point provided. In comparison with the results of the antenna 11 in FIG. 10, as the result of folding the antenna, the upper and the lower conductor flat-plates came closer together causing characteristics to deteriorate along with mismatching of impedance, however, the desired resonance characteristics on two frequency bands were substantially realized.

Figure 25:
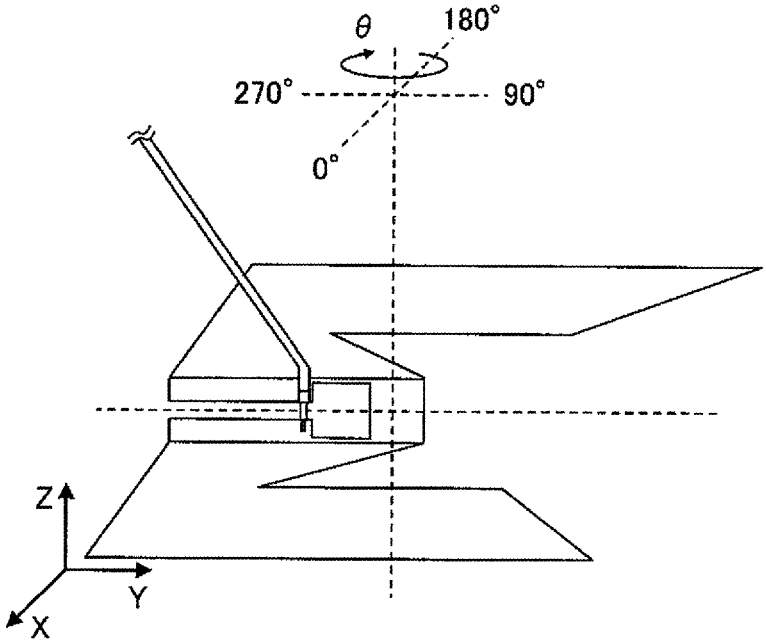
FIG. 25 is a schematic view illustrating a definition of measuring XY-plane on which is measured directivity in the far-field of the antenna of FIG. 22 according to a second embodiment of the present invention.
Figure 26:
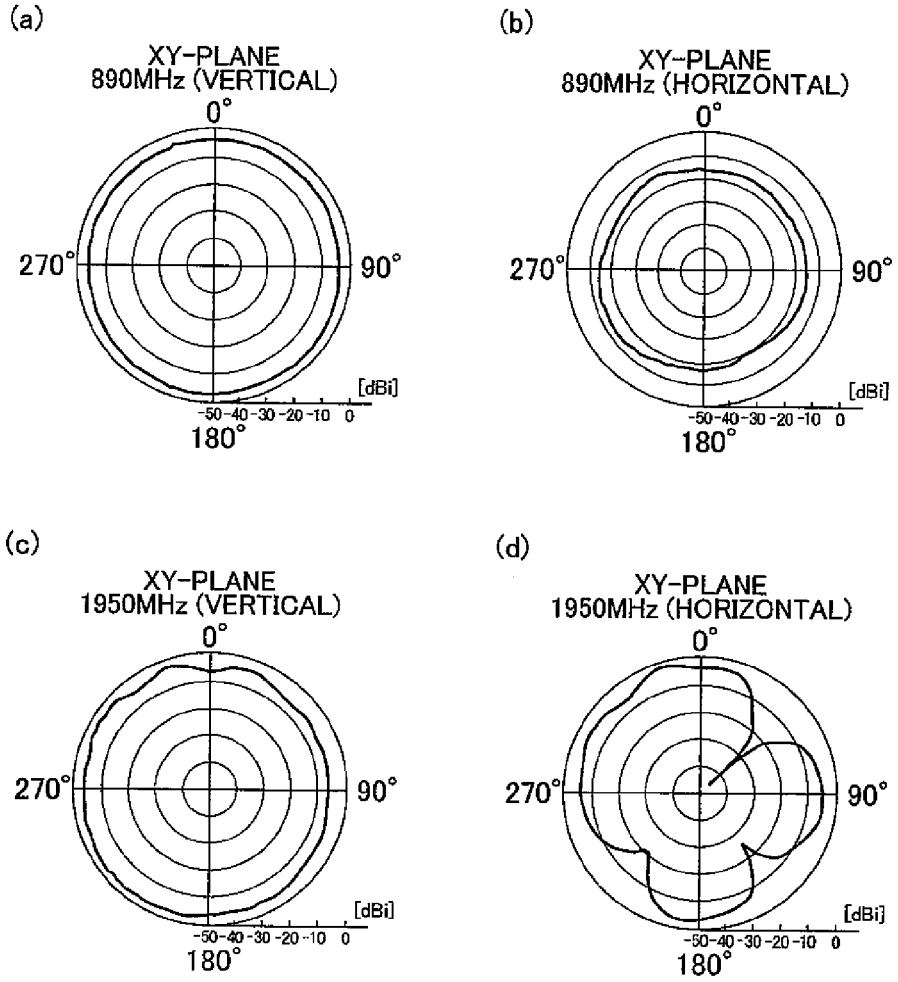
FIG. 26 illustrates measurement results of directivity of the antenna according to a second embodiment of the present invention by measuring on the XY-plane in FIG. 25 in four categories: two frequency bands, a vertically-polarized wave (Vertical) and a horizontally-polarized wave (Horizontal).

FIG. 25 is a schematic view illustrating a definition of measuring XY-plane on which is measured directivity in the far-field of the antenna of FIG. 22 according to a second embodiment of the present invention. FIG. 26 illustrates measurement results of directivity of the antenna according to a second embodiment of the present invention by measuring on the XY-plane in FIG. 25 in four categories: two frequency bands, a vertically-polarized wave (Vertical) and a horizontally-polarized wave (Horizontal). As shown in FIG. 26, at each frequency on the two frequency bands, nondirectivity resulting from a vertically-polarized wave could be obtained. However, in comparison with the characteristics obtained on the XY-plane shown in FIG. 7, the horizontally-polarized wave significantly increased and the vertically-polarized wave slightly decreased. This is because the distance between the upper and the lower conductors became small as the result of folding the antenna, and current generated in the vertical direction on the plane has changed to current generated in the horizontal direction.

Figure 27:
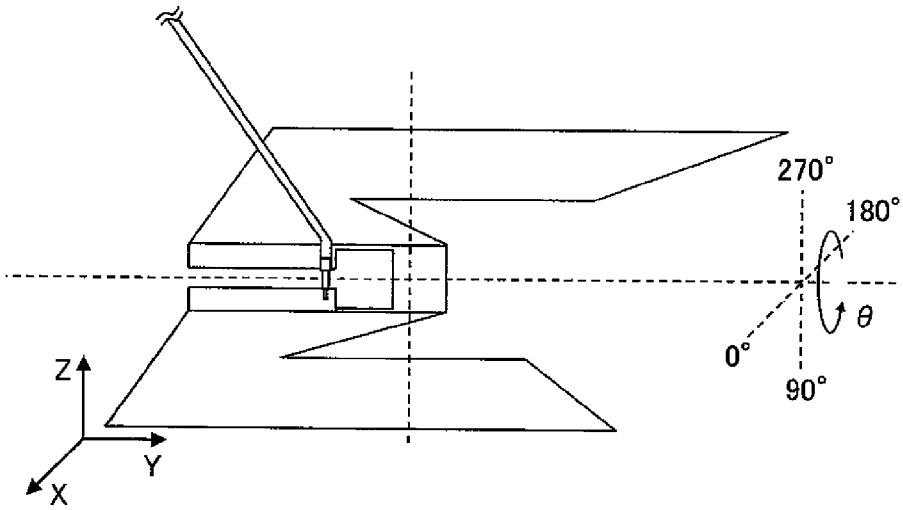
FIG. 27 is a schematic view illustrating a definition of measuring XZ-plane on which is measured directivity in the far-field of the antenna of FIG. 22 according to a second embodiment of the present invention.
Figure 28:
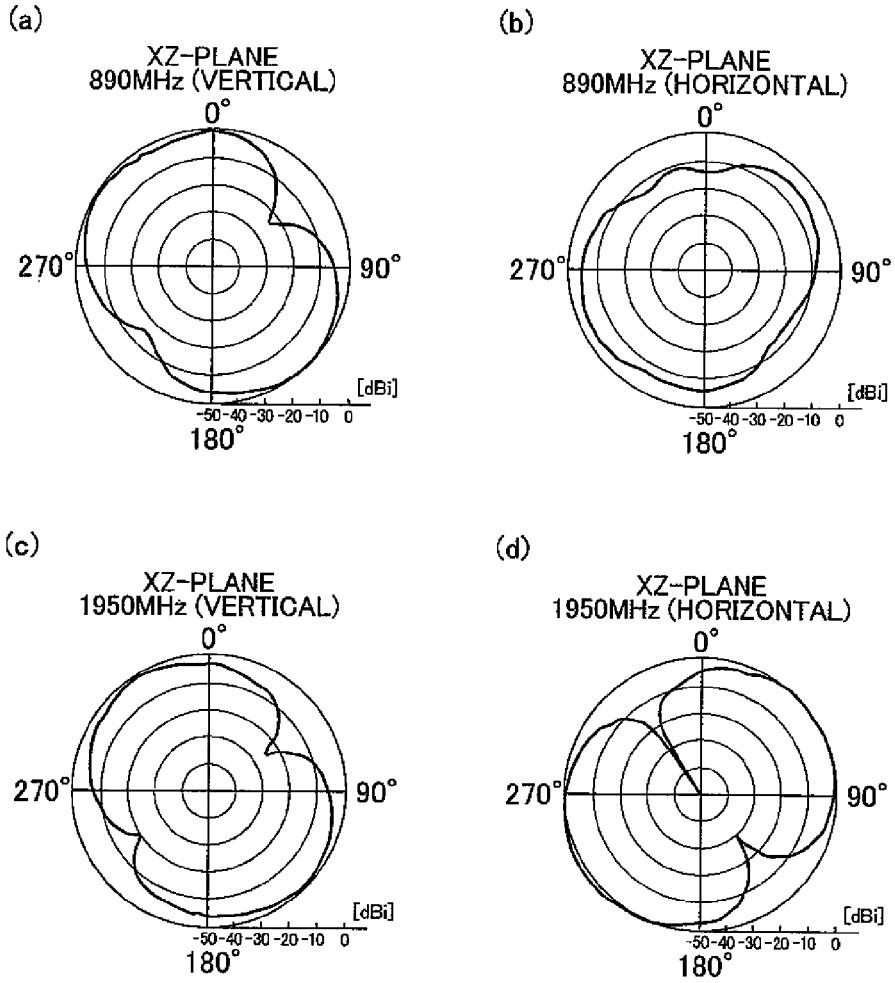
FIG. 28 illustrates measurement results of directivity of the antenna according to a second embodiment of the present invention by measuring on the XZ-plane in FIG. 27 in four categories: two frequency bands, a vertically-polarized wave (Vertical) and a horizontally-polarized wave (Horizontal).

FIG. 27 is a schematic view illustrating a definition of measuring XZ-plane on which is measured directivity in the far-field of the antenna of FIG. 22 according to a second embodiment of the present invention. FIG. 28 illustrates measurement results of directivity of the antenna according to a second embodiment of the present invention by measuring on the XZ-plane in FIG. 27 in four categories: two frequency bands, a vertically-polarized wave (Vertical) and a horizontally-polarized wave (Horizontal). As shown in FIG. 28, at each frequency on the two frequency bands, a vertically-polarized wave with figure-eight directivity could be obtained.

However, it is necessary to tilt the direction of maximum radiation, which is the intermediate direction of the half-power width of the figure-eight directivity, from the perpendicular direction (295° and 115° directions in FIG. 28) to the installation surface of the windshield 80 having an inclination of 25° toward the horizontal direction (0° and 180° directions in FIG. 28). The direction of maximum radiation on two frequency bands shown in FIGS. 28(*a*) and 28(*c*) is oriented at elevation angles of 36° and 32° at the front and at depression angles of 43° and 47° at the rear at 890 and 1950 MHz, respectively. This means that as the result of folding the antenna as shown in FIG. 22 (the side view is described in FIG. 23), when compared to the plane shown in FIG. 10 (the side view is described in FIG. 13), the direction of maximum radiation tilts by 29° and 33° in the horizontal direction at the front and by 22° and 18° in the horizontal direction at the rear. This is because the main electric field generating surface formed by connecting points, by straight lines, farthest from the feeding points in current distributions 91,92 shown in FIGS. 2 and 3 came close to a perpendicular angle to the ground 82 when compared to the plane (FIG. 13).

As the results shown in FIG. 28 indicate, in the antenna 113 according to the second embodiment of the present invention, it is possible to provide an antenna capable of transmitting and receiving radio waves made up of specific polarization components on two different frequency bands in the direction closer to the horizontal direction than a direction on the plane. This is made possible by using two antenna element structures capable of efficiently transmitting and receiving radio waves made up of specific polarization components, in which a feeding point is provided in only one of the two antenna element structures; and the structures are folded along two locations equally distant from the axisymmetrical axis, thereby tilting the direction of maximum radiation on two different frequency bands.

Third Embodiment of Present Invention

Next, a third embodiment of the present invention will be described with reference to FIGS. 29 to 37.

Figure 29:
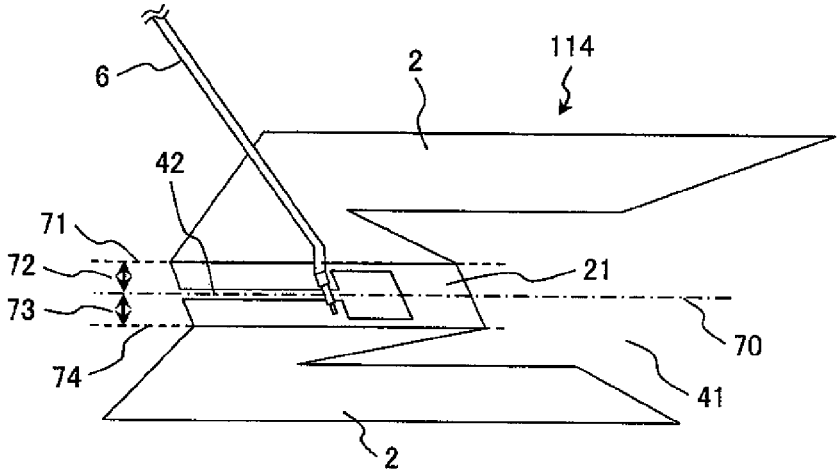
FIG. 29 is a schematic view illustrating a perspective view of an antenna which is pre-investigated for a third embodiment of the present invention.

FIG. 29 is a schematic view illustrating a perspective view of an antenna which is pre-investigated for a third embodiment of the present invention. As shown in FIG. 29, an antenna 114 is folded along the folding positions that are parallel to the axisymmetrical axis 70 with certain intervals (6 mm both upward and downward from the axisymmetrical axis 70 in this embodiment) toward mutually different directions.

Figure 30:
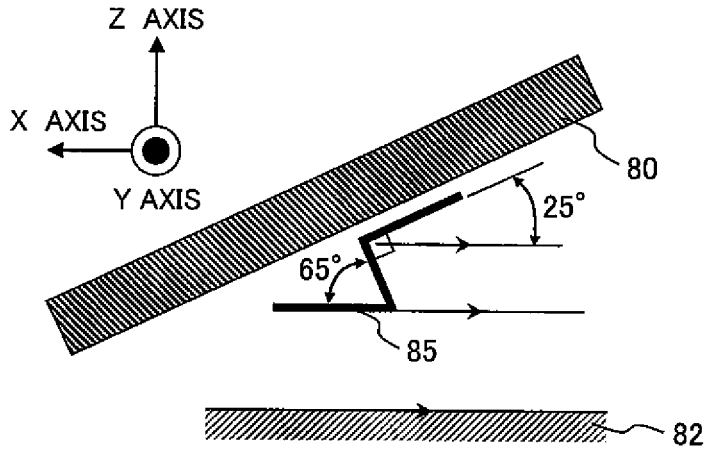
FIG. 30 is a schematic view illustrating a side view of an antenna which is pre-investigated for a third embodiment of the present invention for explaining arrangement of the antenna.

FIG. 30 is a schematic view illustrating a side view of an antenna which is pre-investigated for a third embodiment of the present invention for explaining arrangement of the antenna. The antenna 85 is a side view of the antenna 114 in FIG. 29 and is disposed under the windshield 80 having an inclination of 25°. There is a difference in the folding angle between the antenna 85 and one 83 of the first embodiment.

Figure 31:
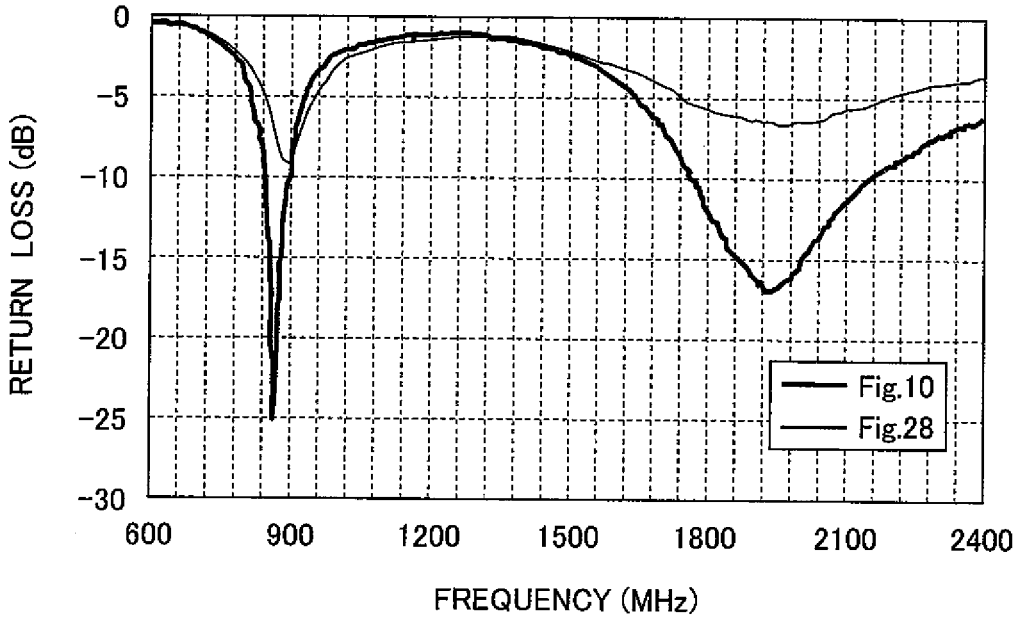
FIG. 31 is a graph showing a relationship between return loss and frequency in the antenna of FIG. 29.

FIG. 31 is a graph showing a relationship between return loss and frequency in the antenna of FIG. 29. In FIG. 31, the frequency is plotted on the horizontal axis and the return loss is plotted on the vertical axis. The results of the antenna 11 of FIG. 10 are also shown in FIG. 31 by a thick line. As shown in FIG. 31, the antenna 114 of FIG. 29 exhibited the resonance characteristics on two frequency bands: 800 MHz on which operation mainly occurred in the composite slot 41 with no feeding point provided; and 1900 MHz on which operation mainly occurred in the rectangle slot 42 with a feeding point provided. In comparison with the results of the antenna 11 in FIG. 10, as the result of folding the antenna, the upper and the lower conductor flat-plates came closer together causing characteristics to significantly deteriorate along with mismatching of impedance.

Figure 32:
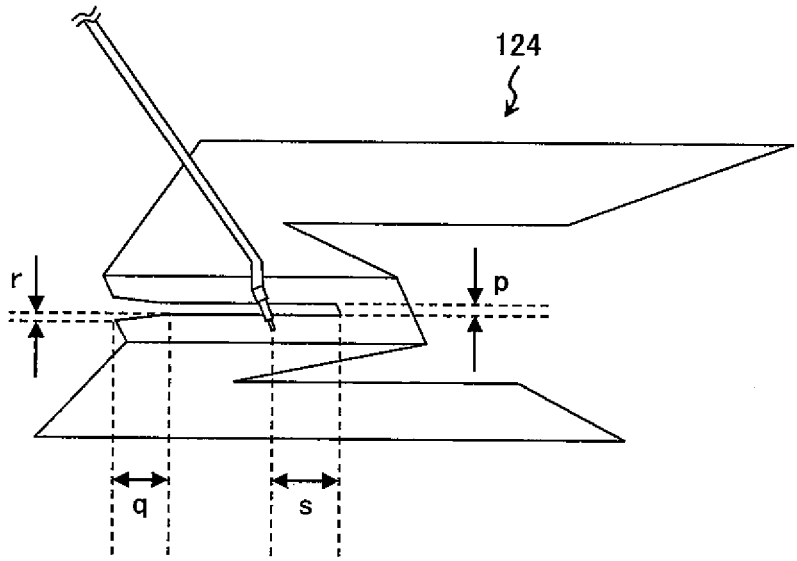
FIG. 32 is a schematic view illustrating a perspective view of an antenna according to a third embodiment of the present invention.

FIG. 32 is a schematic view illustrating a perspective view of an antenna according to a third embodiment of the present invention. As shown in FIG. 32, an antenna 124 has been deformed according to length and width p, q, r, s of each portion in order to adjust impedance matching of the antenna 114 in FIG. 29. In this embodiment, p=2 mm, q=13 mm, r=2.5 mm, and s=8 mm are established.

Figure 33:
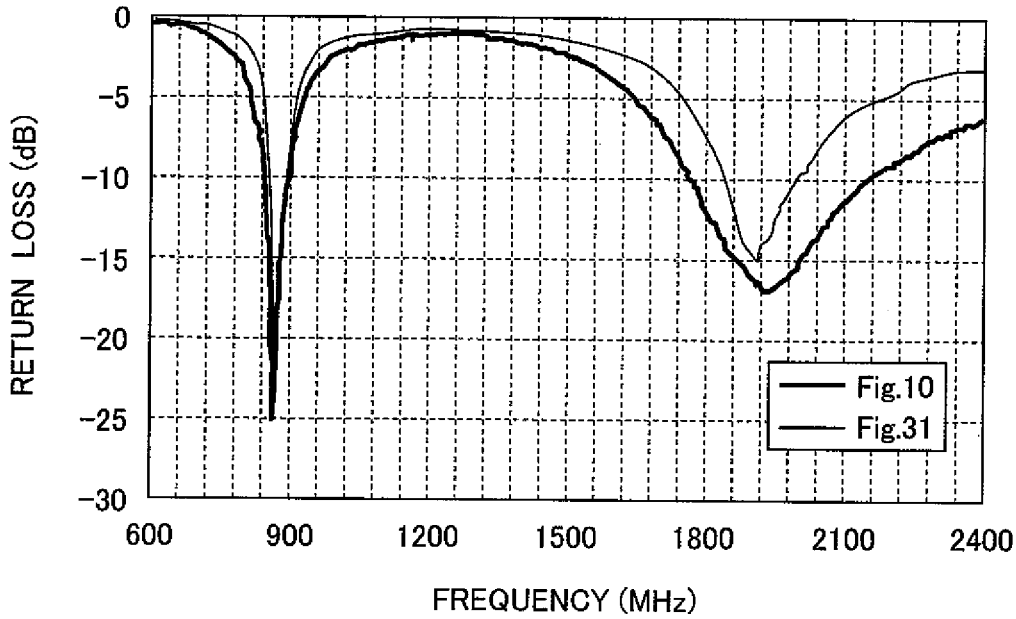
FIG. 33 is a graph showing a relationship between return loss and frequency in the antenna of FIG. 32 according to a third embodiment of the present invention.

FIG. 33 is a graph showing a relationship between return loss and frequency in the antenna of FIG. 32 according to a third embodiment of the present invention. In FIG. 33, the frequency is plotted on the horizontal axis and the return loss is plotted on the vertical axis. The results of the antenna 11 of FIG. 10 are also shown in FIG. 33 by a thick line. By deforming the antenna 124 as shown in FIG. 32, impedance mismatching due to the folding was adjusted, and the desired resonance characteristics on two frequency bands were substantially realized.

Figure 34:
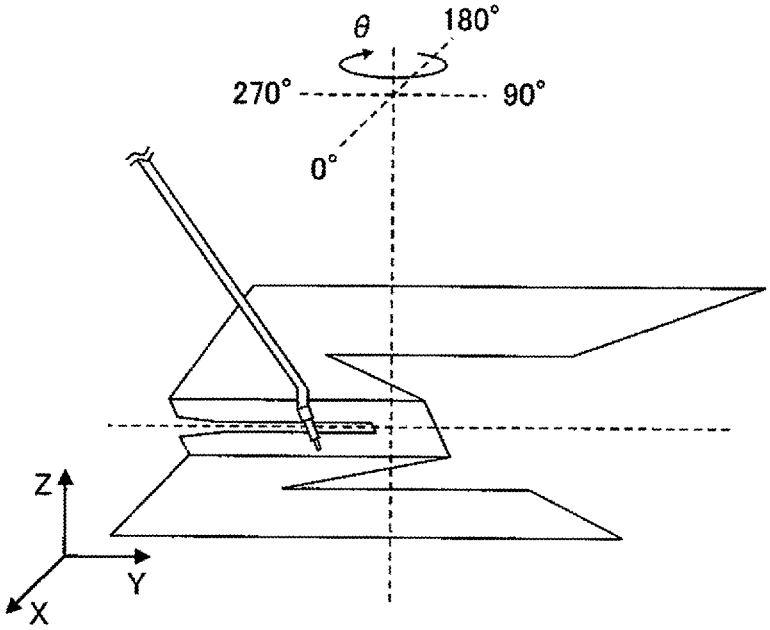
FIG. 34 is a schematic view illustrating a definition of measuring XY-plane on which is measured directivity in the far-field of an antenna according to a third embodiment of the present invention.
Figure 35:
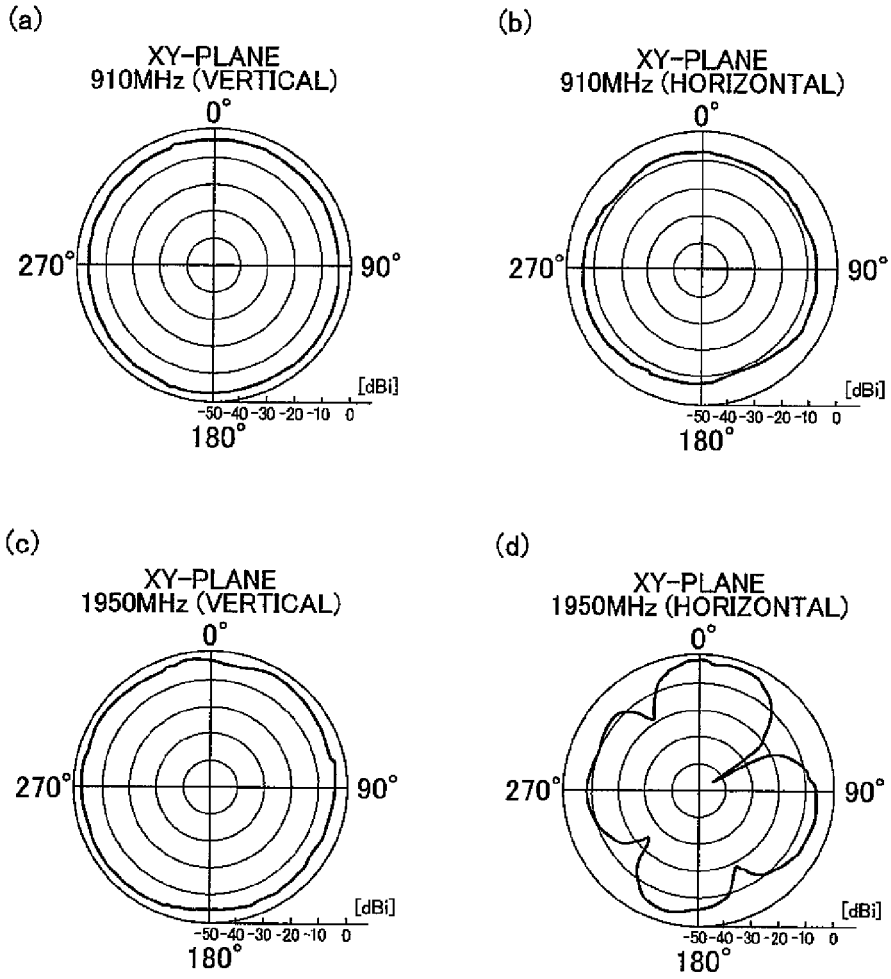
FIG. 35 illustrates measurement results of directivity of the antenna according to a third embodiment of the present invention by measuring on the XX-plane in FIG. 34 in four categories: two frequency bands, a vertically-polarized wave (Vertical) and a horizontally-polarized wave (Horizontal).

FIG. 34 is a schematic view illustrating a definition of measuring XY-plane on which is measured directivity in the far-field of the antenna of FIG. 32 according to a third embodiment of the present invention. FIG. 35 illustrates measurement results of directivity of the antenna according to a third embodiment of the present invention by measuring on the XY-plane in FIG. 34 in four categories: two frequency bands, a vertically-polarized wave (Vertical) and a horizontally-polarized wave (Horizontal). As shown in FIG. 35, at each frequency on the two frequency bands, nondirectivity resulting from a vertically-polarized wave could be obtained. However, in comparison with the characteristics obtained on the XY-plane shown in FIG. 7, the horizontally-polarized wave increased and the vertically-polarized wave slightly decreased. This is because the distance between the upper and the lower conductors became small as the result of folding the antenna, and current generated in the vertical direction on the plane has changed to current generated in the horizontal direction.

Figure 36:
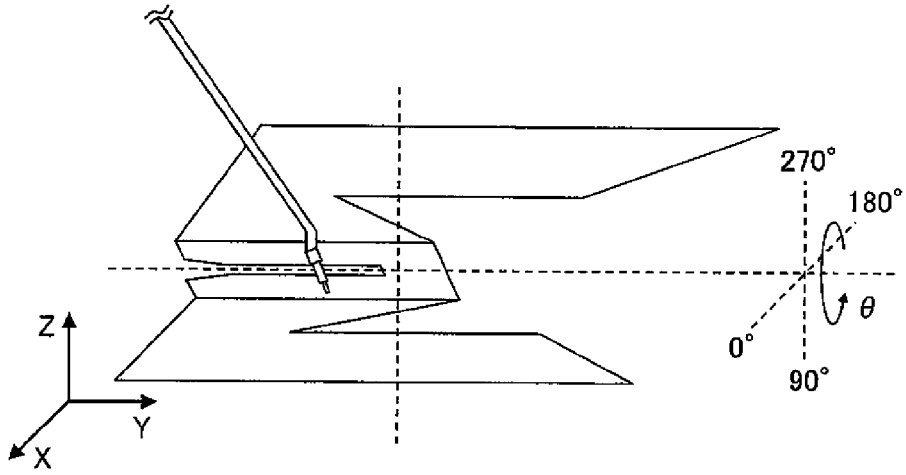
FIG. 36 is a schematic view illustrating a definition of measuring XZ-plane on which is measured directivity in the far-field of the antenna of FIG. 32 according to a third embodiment of the present invention.
Figure 37:
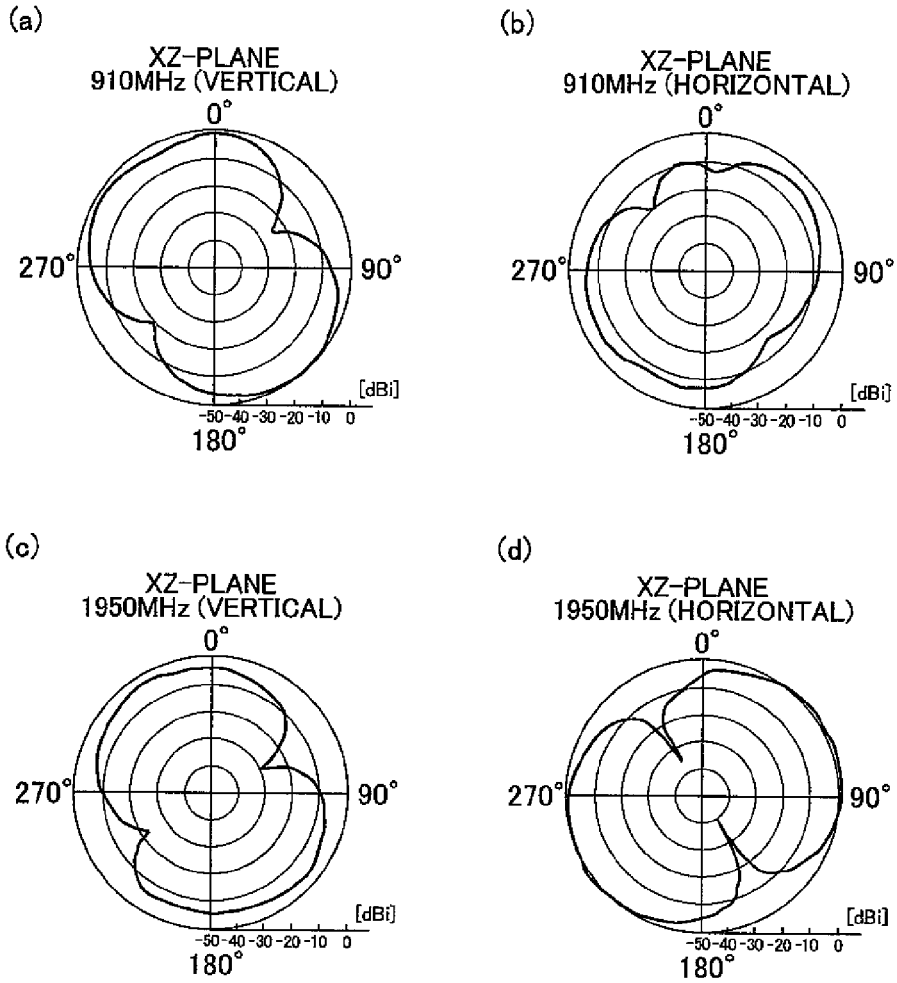
FIG. 37 illustrates measurement results of directivity of the antenna according to a third embodiment of the present invention by measuring on the XZ-plane in FIG. 36 in four categories: two frequency bands, a vertically-polarized wave (Vertical) and a horizontally-polarized wave (Horizontal).

FIG. 36 is a schematic view illustrating a definition of measuring XZ-plane on which is measured directivity in the far-field of the antenna of FIG. 32 according to a third embodiment of the present invention. FIG. 37 illustrates measurement results of directivity of the antenna according to a third embodiment of the present invention by measuring on the XZ-plane in FIG. 36 in four categories: two frequency bands, a vertically-polarized wave (Vertical) and a horizontally-polarized wave (Horizontal). As shown in FIG. 37, at each frequency on the two frequency bands, a vertically-polarized wave with figure-eight directivity could be obtained.

However, it is necessary to tilt the direction of maximum radiation, which is the intermediate direction of the half-power width of the figure-eight directivity, from the perpendicular direction (295° and 115° directions in FIG. 37) to the installation surface of the windshield 80 having an inclination of 25° toward the horizontal direction (0° and 180° directions in FIG. 37). The direction of maximum radiation on two frequency bands shown in FIGS. 37(*a*) and 37(*c*) is oriented at elevation angles of 33° and 28° at the front and at depression angles of 40° and 22° at the rear at 910 and 1950 MHz, respectively. This means that as the result of folding the antenna as shown in FIG. 29 (the side view is described in FIG. 30), when compared to the plane shown in FIG. 10 (the side view is described in FIG. 13), the direction of maximum radiation tilts by 32° and 37° in the horizontal direction at the front and by 25° and 43° in the horizontal direction at the rear. This is because the main electric field generating surface formed by connecting points, by straight lines, farthest from the feeding points in current distributions 91,92 shown in FIGS. 2 and 3 came close to a perpendicular angle to the ground 82 when compared to the plane (FIG. 13).

As the results shown in FIG. 37 indicate, in the antenna 124 according to the third embodiment of the present invention, it is possible to provide an antenna capable of transmitting and receiving radio waves made up of specific polarization components on two different frequency bands in the direction closer to the horizontal direction than a direction on the plane. This is made possible by using two antenna element structures capable of efficiently transmitting and receiving radio waves made up of specific polarization components, in which a feeding point is provided in only one of the two antenna element structures; and the structures are folded along two locations equally distant from the axisymmetrical axis, thereby tilting the direction of maximum radiation on two different frequency bands.

Fourth Embodiment of Present Invention

Next, a fourth embodiment of the present invention will be described with reference to FIGS. 38 to 46.

Figure 38:
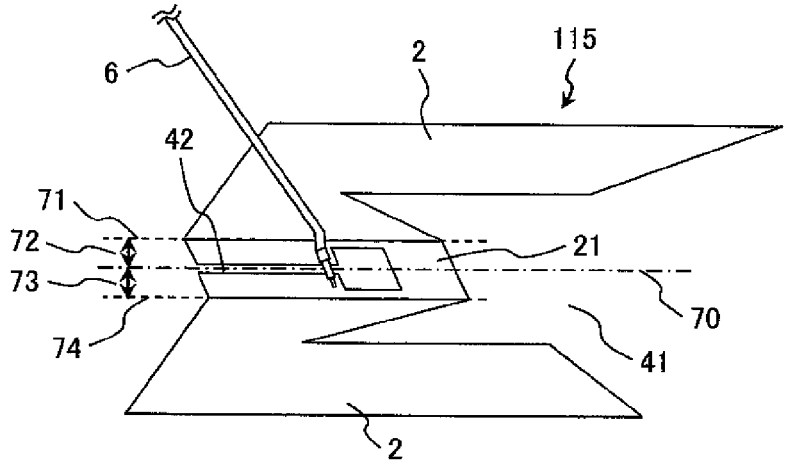
FIG. 38 is a schematic view illustrating a perspective view of an antenna which is pre-investigated for a fourth embodiment of the present invention.

FIG. 38 is a schematic view illustrating a perspective view of an antenna which is pre-investigated for a fourth embodiment of the present invention. As shown in FIG. 38, an antenna 115 is folded along the folding positions that are parallel to the axisymmetrical axis 70 with certain intervals (6 mm both upward and downward from the axisymmetrical axis 70 in this embodiment) toward mutually different directions.

Figure 39:
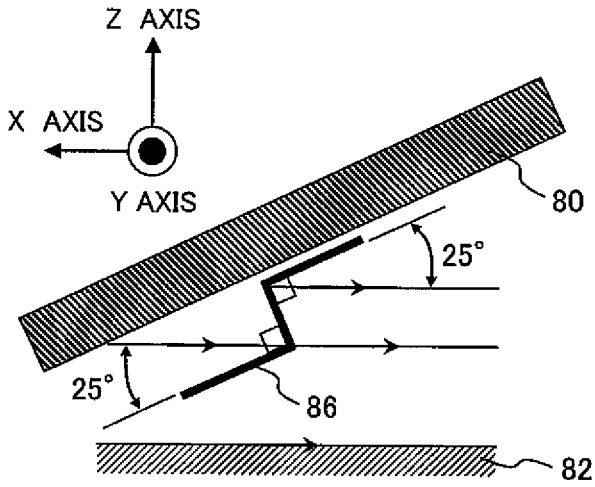
FIG. 39 is a schematic view illustrating a side view of an antenna which is pre-investigated for a fourth embodiment of the present invention for explaining arrangement of the antenna.

FIG. 39 is a schematic view illustrating a side view of an antenna which is pre-investigated for a fourth embodiment of the present invention for explaining arrangement of the antenna. The antenna 86 is a side view of the antenna 115 in FIG. 38 and is disposed under the windshield 80 having an inclination of 25°. There is a difference in the folding angle between the antenna 86 and one 83 of the first embodiment.

Figure 40:
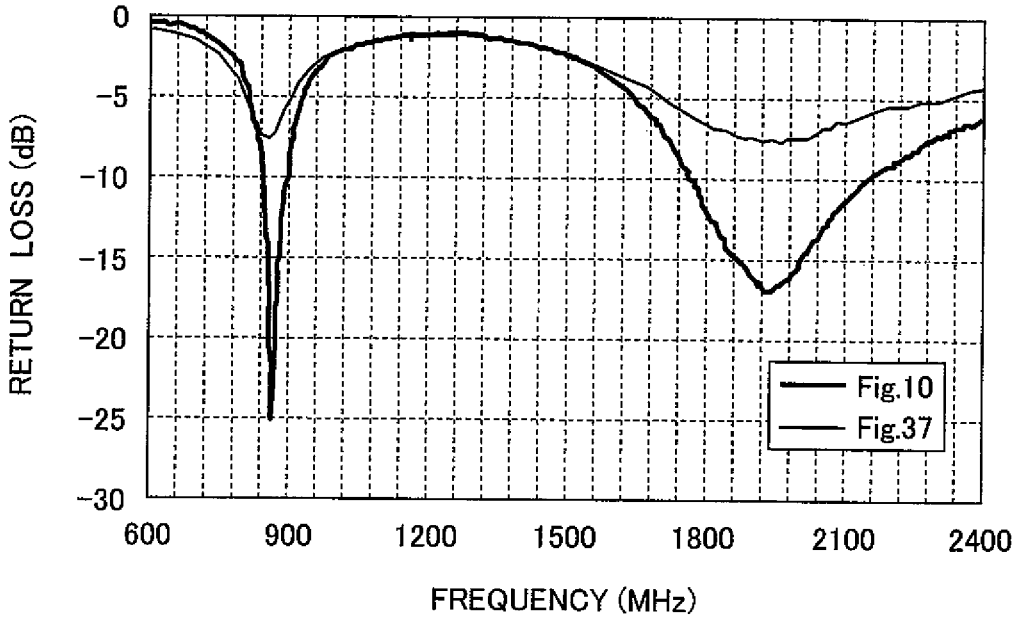
FIG. 40 is a graph showing a relationship between return loss and frequency in the antenna of FIG. 38.

FIG. 40 is a graph showing a relationship between return loss and frequency in the antenna of FIG. 38. In FIG. 40, the frequency is plotted on the horizontal axis and the return loss is plotted on the vertical axis. The results of the antenna 11 of FIG. 10 are also shown in FIG. 40 by a thick line. As shown in FIG. 40, the antenna 115 of FIG. 38 exhibited the resonance characteristics on two frequency bands: 800 MHz on which operation mainly occurred in the composite slot 41 with no feeding point provided; and 1900 MHz on which operation mainly occurred in the rectangle slot 42 with a feeding point provided. In comparison with the results of the antenna 11 in FIG. 10, as the result of folding the antenna, the upper and the lower conductor flat-plates came closer together causing characteristics to significantly deteriorate along with mismatching of impedance.

Figure 41:
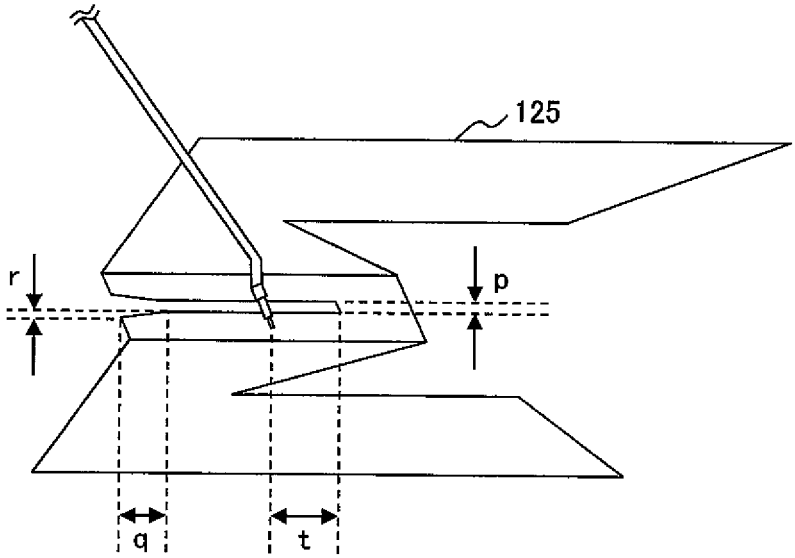
FIG. 41 is a schematic view illustrating a perspective view of an antenna according to a fourth embodiment of the present invention.

FIG. 41 is a schematic view illustrating a perspective view of an antenna according to a fourth embodiment of the present invention. As shown in FIG. 41, an antenna 125 has been deformed according to length and width p, q, r, t of each portion in order to adjust impedance matching of the antenna 115 in FIG. 38. In this embodiment, p=2 mm, q=13 mm, r=2.5 mm, and t=9 mm are established.

Figure 42:
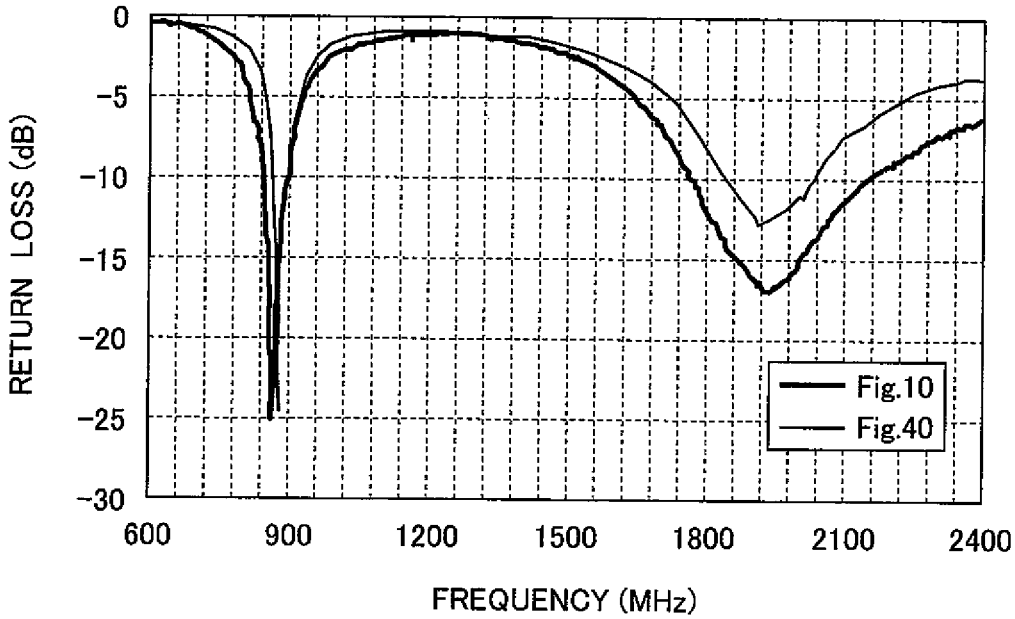
FIG. 42 is a graph showing a relationship between return loss and frequency in the antenna of FIG. 41 according to a fourth embodiment of the present invention.

FIG. 42 is a graph showing a relationship between return loss and frequency in the antenna of FIG. 41 according to a fourth embodiment of the present invention. In FIG. 42, the frequency is plotted on the horizontal axis, and the return loss is plotted on the vertical axis. The results of the antenna 11 of FIG. 10 are also shown in FIG. 42 by a thick line. By deforming the antenna 125 as shown in FIG. 41, impedance mismatching due to the folding was adjusted, and the desired resonance characteristics on two frequency bands were substantially realized.

Figure 43:
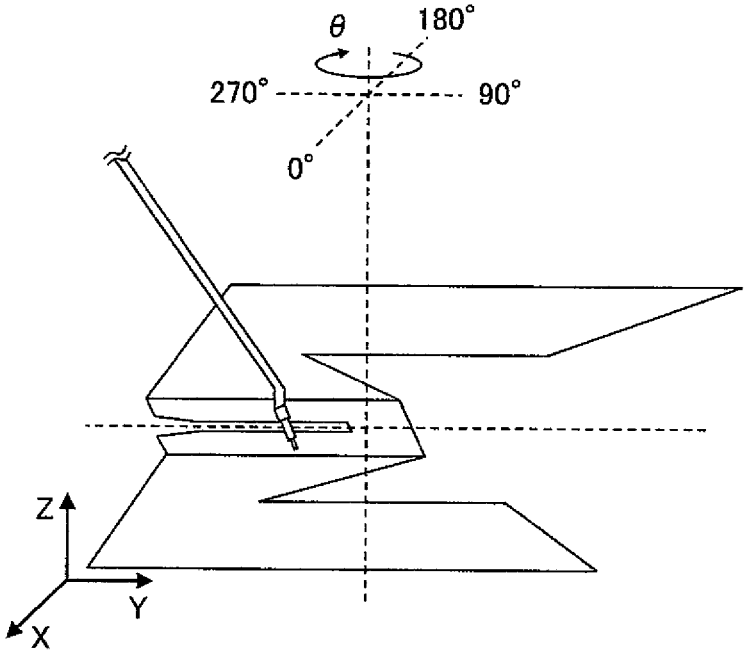
FIG. 43 is a schematic view illustrating a definition of measuring XY-plane on which is measured directivity in the far-field of the antenna of FIG. 41 according to a fourth embodiment of the present invention.
Figure 44:
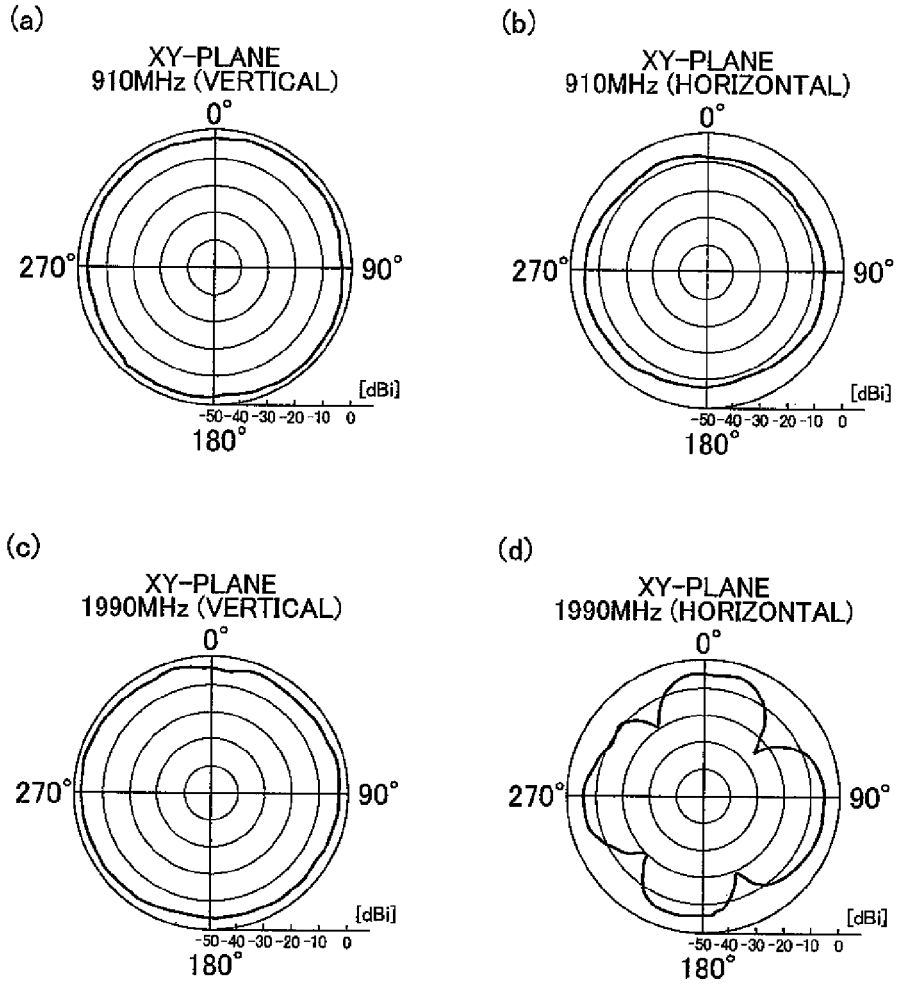
FIG. 44 illustrates measurement results of directivity of the antenna according to a third embodiment of the present invention by measuring on the XY-plane in FIG. 43 in four categories: two frequency bands, a vertically-polarized wave (Vertical) and a horizontally-polarized wave (Horizontal).

FIG. 43 is a schematic view illustrating a definition of measuring XY-plane on which is measured directivity in the far-field of the antenna of FIG. 41 according to a fourth embodiment of the present invention. FIG. 44 illustrates measurement results of directivity of the antenna according to a third embodiment of the present invention by measuring on the XY-plane in FIG. 43 in four categories: two frequency bands, a vertically-polarized wave (Vertical) and a horizontally-polarized wave (Horizontal). As shown in FIG. 44, at each frequency on the two frequency bands, nondirectivity resulting from a vertically-polarized wave could be obtained. However, in comparison with the characteristics obtained on the XY-plane shown in FIG. 7, the horizontally-polarized wave increased and the vertically-polarized wave slightly decreased. This is because the distance between the upper and the lower conductors became small as the result of folding the antenna, and current generated in the vertical direction on the plane has changed to current generated in the horizontal direction.

Figure 45:
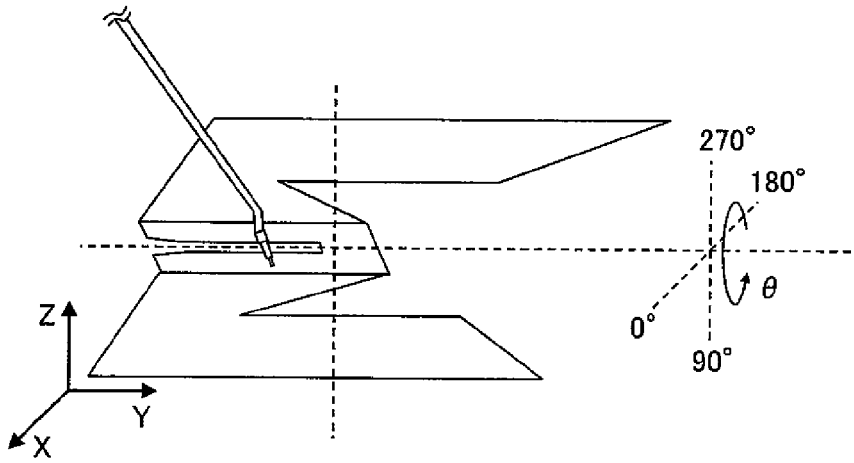
FIG. 45 is a schematic view illustrating a definition of measuring XZ-plane on which is measured directivity in the far-field of an antenna according to a fourth embodiment of the present invention.
Figure 46:
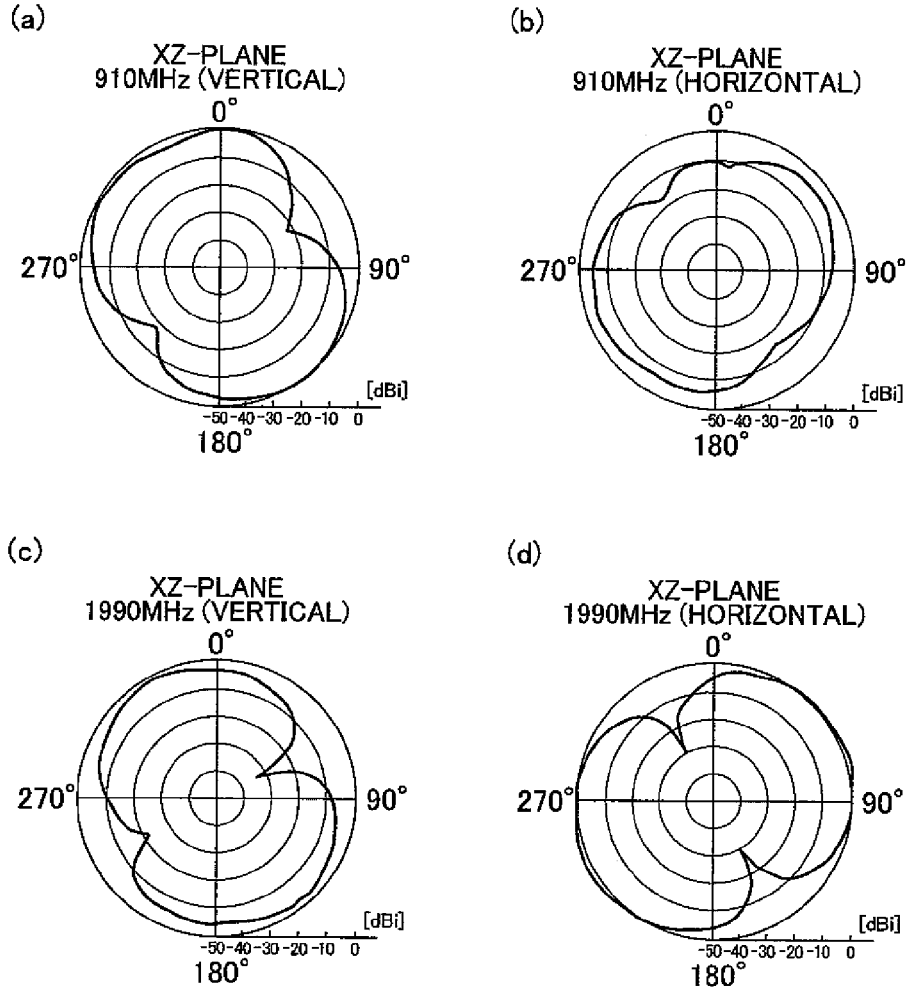
FIG. 46 illustrates measurement results of directivity of the antenna according to a fourth embodiment of the present invention by measuring on the XZ-plane in FIG. 45 in four categories: two frequency bands, a vertically-polarized wave (Vertical) and a horizontally-polarized wave (Horizontal).

FIG. 45 is a schematic view illustrating a definition of measuring XZ-plane on which is measured directivity in the far-field of the antenna of FIG. 41 according to a fourth embodiment of the present invention. FIG. 46 illustrates measurement results of directivity of the antenna according to a fourth embodiment of the present invention by measuring on the XZ-plane in FIG. 45 in four categories: two frequency bands, a vertically-polarized wave (Vertical) and a horizontally-polarized wave (Horizontal). As shown in FIG. 46, at each frequency on the two frequency bands, a vertically-polarized wave with figure-eight directivity could be obtained.

However, it is necessary to tilt the direction of maximum radiation, which is the intermediate direction of the half-power width of the figure-eight directivity, from the perpendicular direction (295° and 115° directions in FIG. 37) to the installation surface of the windshield 80 having an inclination of 25° toward the horizontal direction (0° and 180° directions in FIG. 37). The direction of maximum radiation on two frequency bands shown in FIGS. 46(*a*) and 46(*c*) is oriented at elevation angles of 31° and 24° at the front and at depression angles of 38° and 25° at the rear at 910 and 1990 MHz, respectively. This means that as the result of folding the antenna as shown in FIG. 38 (the side view is described in FIG. 39), when compared to the plane shown in FIG. 10 (the side view is described in FIG. 13), the direction of maximum radiation tilts by 34° and 41° in the horizontal direction at the front and by 27° and 40° in the horizontal direction at the rear. This is because the main electric field generating surface formed by connecting points, by straight lines, farthest from the feeding points in current distributions 91,92 shown in FIGS. 2 and 3 came close to a perpendicular angle to the ground 82 when compared to the plane (FIG. 13).

As the results shown in FIG. 46 indicate, in the antenna 125 according to the fourth embodiment of the present invention, it is possible to provide an antenna capable of transmitting and receiving radio waves made up of specific polarization components on two different frequency bands in the direction closer to the horizontal direction than a direction on the plane. This is made possible by using two antenna element structures capable of efficiently transmitting and receiving radio waves made up of specific polarization components, in which a feeding point is provided in only one of the two antenna element structures; and the structures are folded along two locations equally distant from the axisymmetrical axis, thereby tilting the direction of maximum radiation on two different frequency bands.

[Effect of Folding Angle]

Next, comparison of characteristics concerning a folding angle will be explained with reference to FIGS. 47 to 49.

Figure 47:
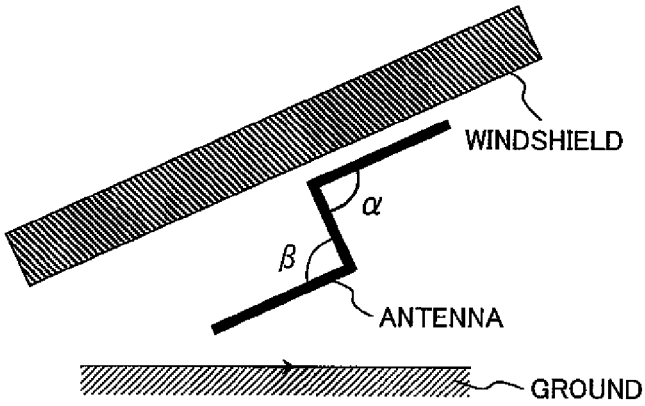
FIG. 47 is a schematic illustration explaining the structure and arrangement of an antenna according to first through fourth embodiments of the present invention by folding angles.

FIG. 47 is a schematic illustration explaining the structure and arrangement of an antenna according to first through fourth embodiments of the present invention by folding angles. $\alpha$ is a folding angle between the upper and middle conductor portions of the antenna, and $\beta$ is a folding angle between the middle and lower conductor portions of the antenna. Symbols E1 through E4 in the drawing correspond to first through fourth embodiments.

Figure 48:
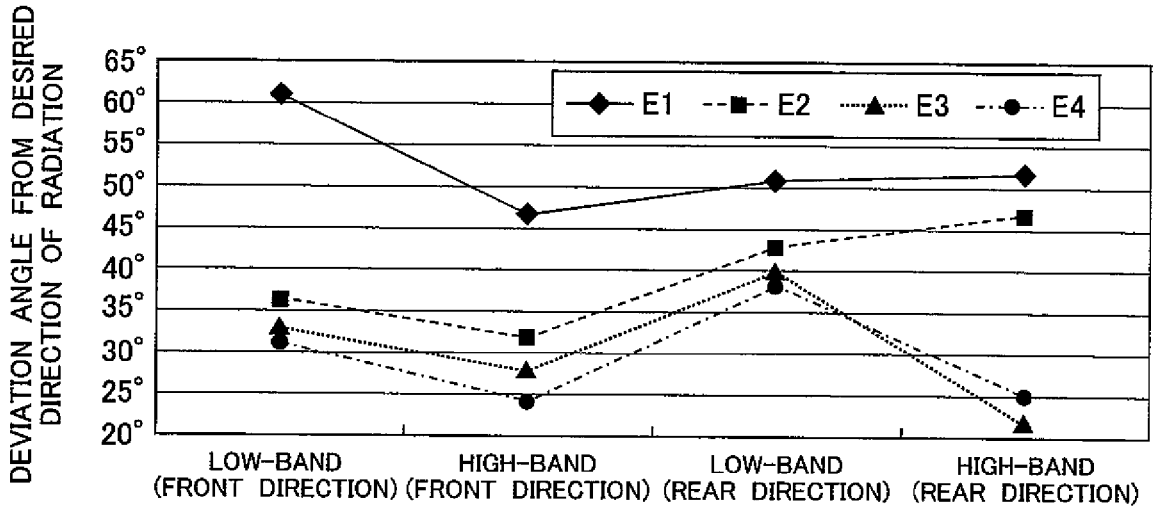
FIG. 48 shows a comparison of deviation angle from target direction of antennas according to first through fourth embodiments.

FIG. 48 shows a comparison of deviation angle from target direction of antennas according to first through fourth embodiments. Assuming that: the front direction is 0°; the rear direction is 180°; and these directions are horizontal to the ground, the drawing compares deviation angle, according to each band and direction, at which the direction of maximum radiation of figure-eight directivity of the antenna is deviated from the front direction or rear direction.

As shown in FIG. 48, the antenna E4 had the smallest deviation angle (the deviation angle was the closest to)0° except the case of the high-band and rear direction, exhibiting good characteristics. The antennas in which the direction of maximum radiation was preferable were in sequential order of E4, E3, E2, and E1.

Figure 49:
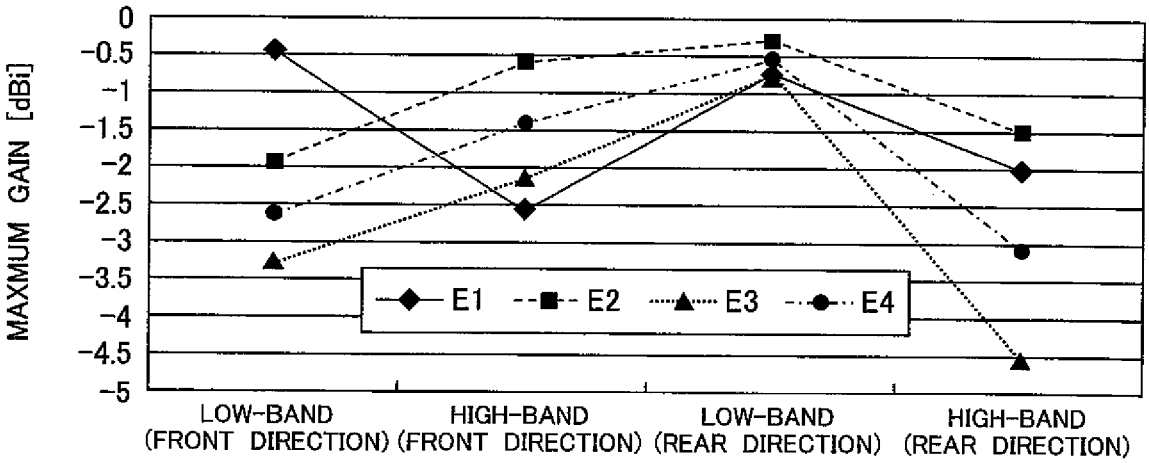
FIG. 49 shows another comparison of maximum gain of antennas according to first through fourth embodiments.

FIG. 49 shows another comparison of the radiation characteristics of antennas according to first through fourth embodiments. In the same manner, assuming that: the front direction is 0°; the rear direction is 180°, and these directions are horizontal to the ground, the drawing compares the maximum gain of figure-eight directivity of the antenna, according to each band and direction.

As shown in FIG. 49, the antenna E2 had the highest maximum gain except the case of the low-band and front direction, exhibiting good characteristics. The antennas in which the maximum gain was preferable were in sequential order of E2, E1, E4, and E3.

Furthermore, when antennas having the same area before folding and almost the same shape were folded at each folding angle of E1 through E4 and then volumes of the antennas were compared, the sequential order from small to large was E3, E1, E4, and E2. When compared in terms of facilitation of folding, the sequential order from easiness of folding was E4, E1, E2, and E3. Consequently, when scores 1 to 4 points were allocated from the first place to the fourth place, respectively, in terms of the direction of maximum radiation, maximum gain, volume, and the easiness of folding, and the antenna with the least scores was considered the most excellent, the most excellent antenna was E4 ($\alpha$=90° and $\beta$90°).

[Effect of Configuration]

Next, effect of configuration of an antenna will be explained with reference to FIGS. 50A to 53.

Figure 50A:
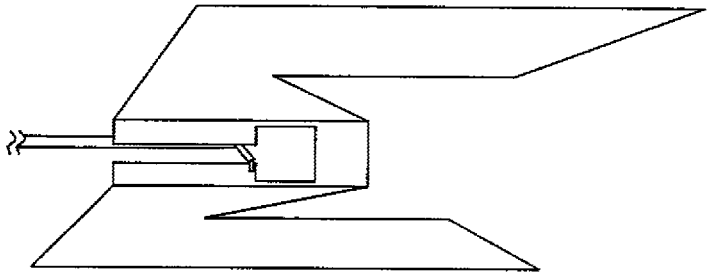
FIG. 50A is a schematic view illustrating a perspective view of an antenna to which a coaxial cable used for feeding power is connected for explaining arrangement of the coaxial cable.
Figure 50B:
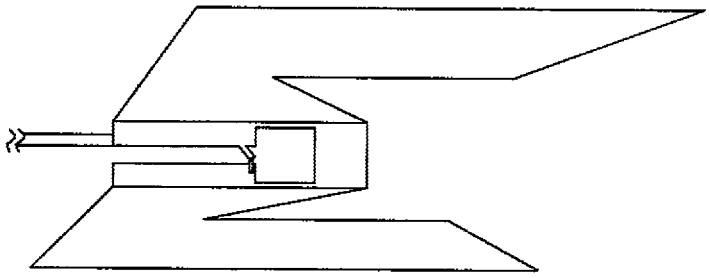
FIG. 50B is another schematic view illustrating a perspective view of an antenna to which a coaxial cable used for feeding power is connected for explaining arrangement of the coaxial cable.

FIG. 50A is a schematic view illustrating a perspective view of an antenna to which a coaxial cable used for feeding power is connected for explaining arrangement of the coaxial cable; and FIG. 50B is another schematic view illustrating a perspective view of an antenna to which a coaxial cable used for feeding power is connected. A part of the coaxial cable enters the rectangle slot of the antenna, as shown in FIG. 50A. On the other hand, the coaxial cable does not enter the rectangle slot of the antenna, as shown in FIG. 50B. It was confirmed that good characteristics of antenna could not be obtained in the arrangement shown in FIG. 50A. In other words, the arrangement shown in FIG. 50B is preferable.

The power feeding cable of the antenna can be extended in the direction horizontal to the antenna's lengthwise direction and be connected to the antenna's feeding point. Also, the power feeding cable can be extended in the direction horizontal to the antenna's widthwise direction and be connected to the antenna's feeding point. Furthermore, the power feeding cable can be extended in the direction perpendicular to the antenna's structure face and connected to the antenna's feeding point.

Figure 51:
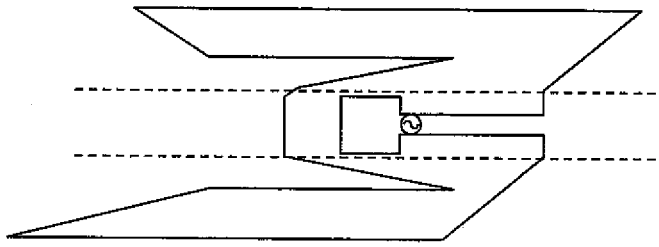
FIG. 51 is schematic views illustrating a perspective view of an antenna with preferred folding positions according to the present invention.
Figure 51:
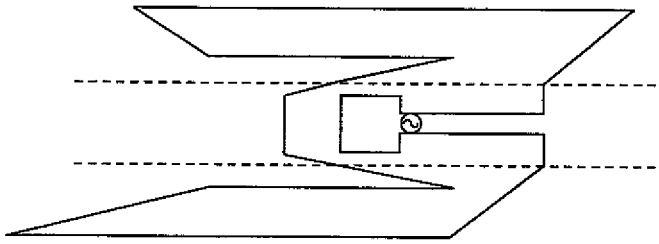
Figure 51:
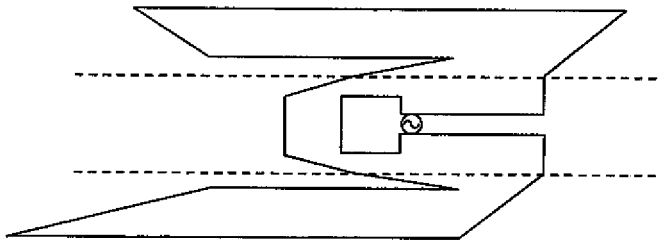

FIG. 51 is schematic views illustrating a perspective view of an antenna with preferred folding positions according to the present invention. In the foregoing embodiments, it was confirmed that changes in resonance frequency were within ±20 MHz as long as folding positions were equally distant from the axisymmetrical axis as shown in, e.g., FIGS. 51(*a*) to 51(*c*).

Figure 52:
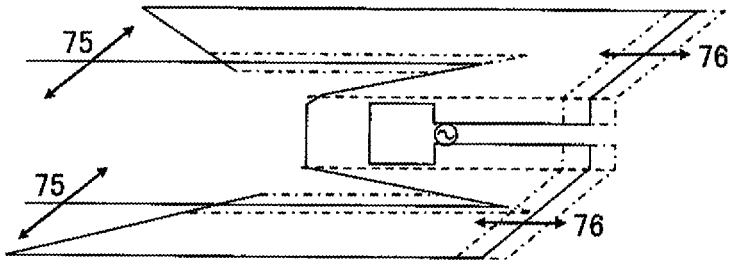
FIG. 52 is schematic views illustrating a perspective view of an antenna for explaining how to adjust resonance frequency of the antenna according to the present invention.

FIG. 52 is schematic views illustrating a perspective view of an antenna for explaining how to adjust resonance frequency of the antenna according to the present invention. In the aforementioned embodiments, it was confirmed that resonance frequency could be adjusted without deteriorating resonance characteristics by vertically-symmetrically deforming the upper and lower conductor portions 75 to adjust resonance frequency on the 800 MHz band and by vertically-symmetrically deforming the upper and lower conductor portions 76 to adjust resonance frequency on the 1900 MHz band.

Figure 53:
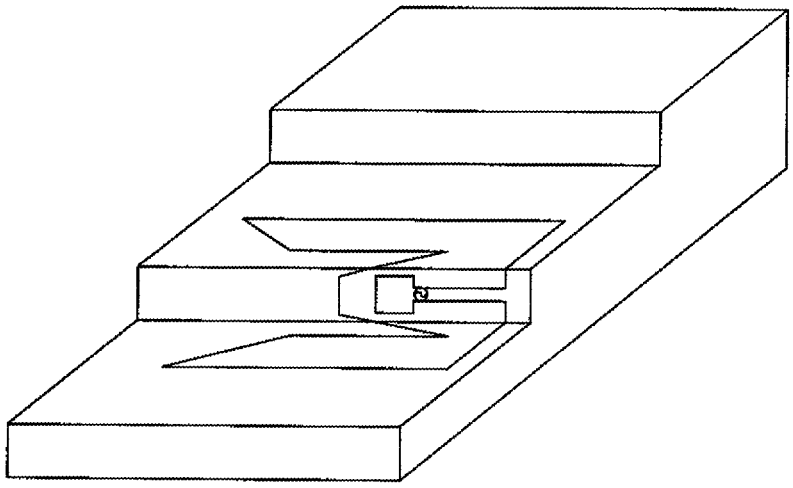
FIG. 53 is schematic views illustrating an exemplary installation of an antenna according to the present invention.

FIG. 53 is schematic views illustrating an exemplary installation of an antenna according to the present invention. In the fourth embodiment, the antenna 125 can be installed onto a step-like object as shown in FIG. 53.

Other Embodiments of Present Invention

The shape of slot of the antenna according to the present invention is not intended to be limited to the shape in the abovementioned embodiments. For example, an axisymmetrical slot can be formed so that its axisymmetrical axis matches the axisymmetrical axis of the conductor flat-plate. An example of a slot shape to which the present invention can be applied will be explained with reference to FIGS. 54 to 70.

Figure 54:
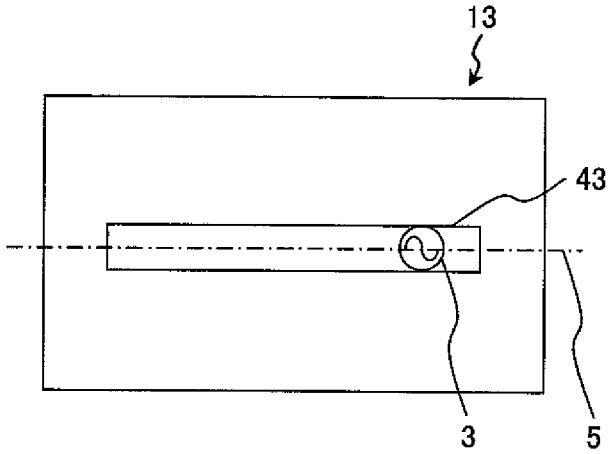
FIG. 54 is a schematic view illustrating a plane view of an antenna in which an applicable slot is formed according to the present invention.

FIG. 54 is a schematic view illustrating a plane view of an antenna in which an applicable slot is formed according to the present invention. As shown in FIG. 54, an axisymmetrical rectangle slot 43 of a both-end short-circuit type can be formed in the antenna 13.

Figure 55:
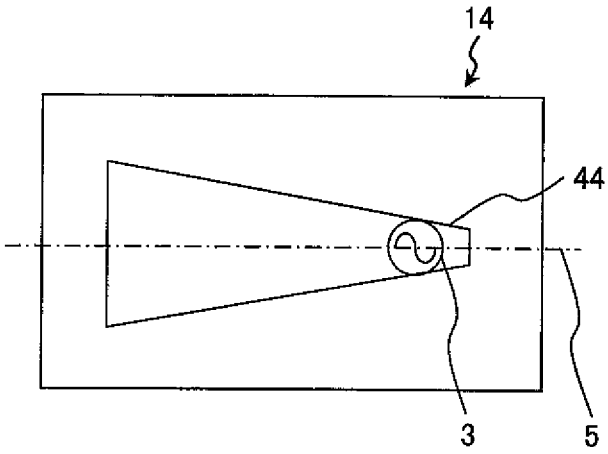
FIG. 55 is a schematic view illustrating a plane view of an antenna in which another applicable slot is formed according to the present invention.

FIG. 55 is a schematic view illustrating a plane view of an antenna in which another applicable slot is formed according to the present invention. As shown in FIG. 55, an axisymmetrical trapezoid slot 44 of a both-end short-circuit type can be formed in the antenna 14.

Figure 56:
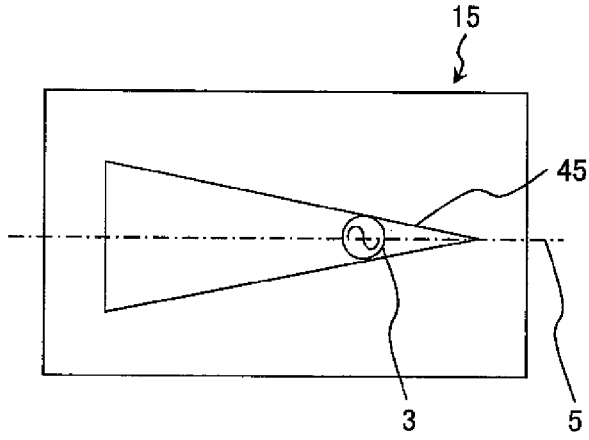
FIG. 56 is a schematic view illustrating a plane view of an antenna in which still another applicable slot is formed according to the present invention.

FIG. 56 is a schematic view illustrating a plane view of an antenna in which still another applicable slot is formed according to the present invention. As shown in FIG. 56, an axisymmetrical triangle slot 45 of a both-end short-circuit type can be formed in the antenna 15.

Figure 57:
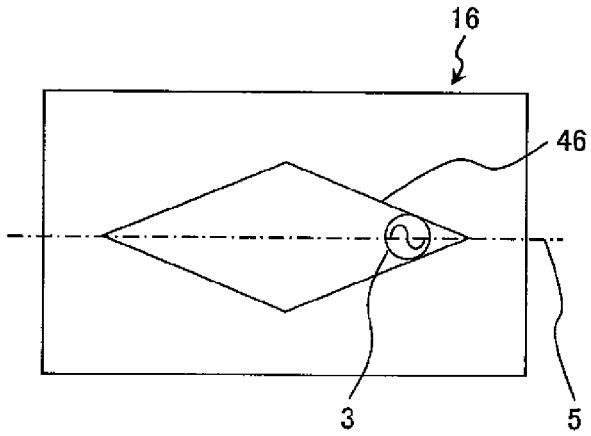
FIG. 57 is a schematic view illustrating a plane view of an antenna in which still another applicable slot is formed according to the present invention.

FIG. 57 is a schematic view illustrating a plane view of an antenna in which still another applicable slot is formed according to the present invention. As shown in FIG. 57, an axisymmetrical rhombus slot 46 of a both-end short-circuit type can be formed in the antenna 16.

Figure 58:
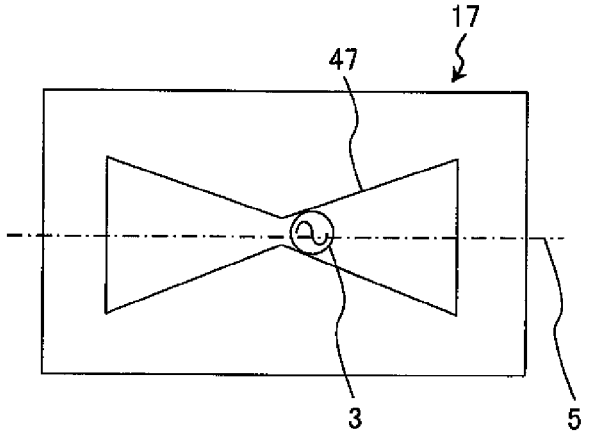
FIG. 58 is a schematic view illustrating a plane view of an antenna in which still another applicable slot is formed according to the present invention.

FIG. 58 is a schematic view illustrating a plane view of an antenna in which still another applicable slot is formed according to the present invention. As shown in FIG. 58, an axisymmetrical bow-tie shape slot 47 of a both-end short-circuit type can be formed in the antenna 17.

Figure 59:
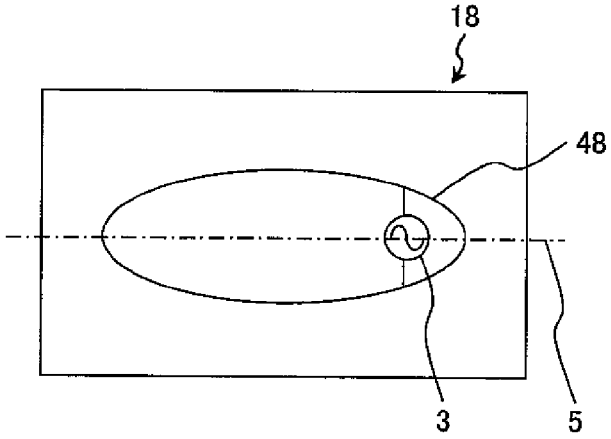
FIG. 59 is a schematic view illustrating a plane view of an antenna in which still another applicable slot is formed according to the present invention.

FIG. 59 is a schematic view illustrating a plane view of an antenna in which still another applicable slot is formed according to the present invention. As shown in FIG. 59, an axisymmetrical ellipse shape slot 48 of a both-end short-circuit type can be formed in the antenna 18.

Figure 60:
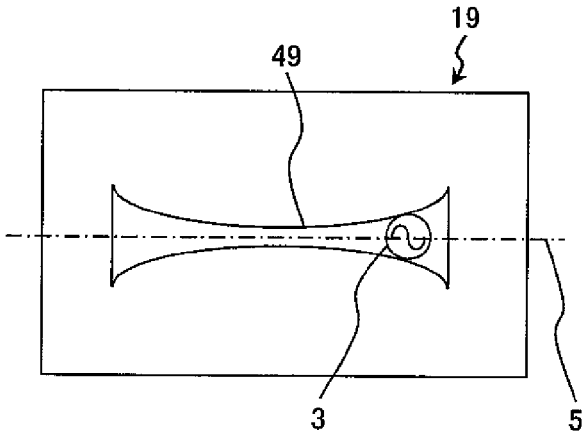
FIG. 60 is a schematic view illustrating a plane view of an antenna in which still another applicable slot is formed according to the present invention.

FIG. 60 is a schematic view illustrating a plane view of an antenna in which still another applicable slot is formed according to the present invention. As shown in FIG. 60, an axisymmetrical hourglass shape slot 49 of a both-end short-circuit type can be formed in the antenna 19.

Figure 61:
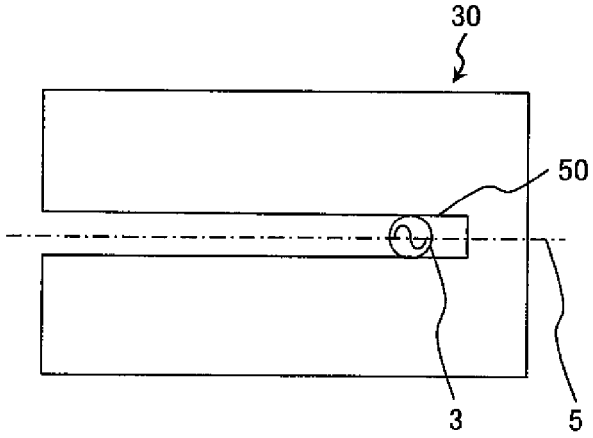
FIG. 61 is a schematic view illustrating a plane view of an antenna in which still another applicable slot is formed according to the present invention.

FIG. 61 is a schematic view illustrating a plane view of an antenna in which still another applicable slot is formed according to the present invention. As shown in FIG. 61, an axisymmetrical rectangle slot 50 of a one-end open type can be formed in the antenna 30.

Figure 62:
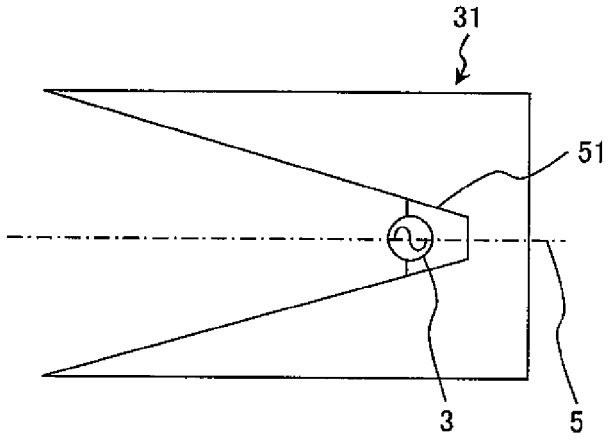
FIG. 62 is a schematic view illustrating a plane view of an antenna in which still another applicable slot is formed according to the present invention.

FIG. 62 is a schematic view illustrating a plane view of an antenna in which still another applicable slot is formed according to the present invention. As shown in FIG. 62, an axisymmetrical trapezoid slot 51 of a one-end open type can be formed in the antenna 31.

Figure 63:
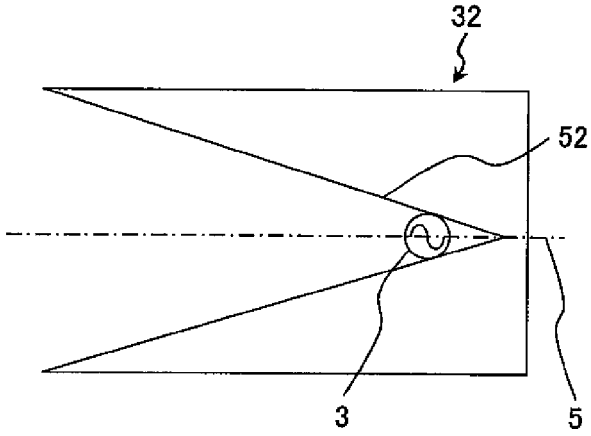
FIG. 63 is a schematic view illustrating a plane view of an antenna in which still another applicable slot is formed according to the present invention.

FIG. 63 is a schematic view illustrating a plane view of an antenna in which still another applicable slot is formed according to the present invention. As shown in FIG. 63, an axisymmetrical triangle slot 52 of a one-end open type can be formed in the antenna 32.

Figure 64:
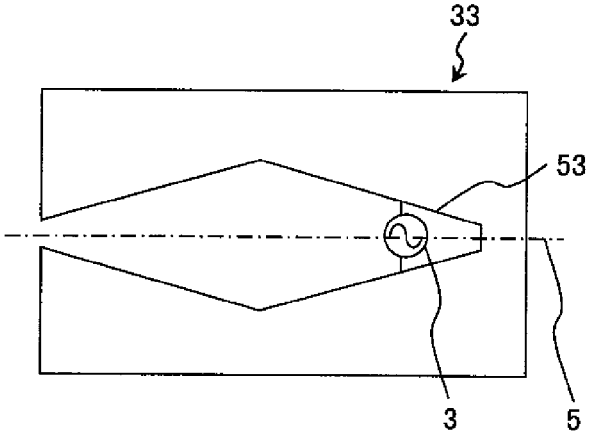
FIG. 64 is a schematic view illustrating a plane view of an antenna in which still another applicable slot is formed according to the present invention.

FIG. 64 is a schematic view illustrating a plane view of an antenna in which still another applicable slot is formed according to the present invention. As shown in FIG. 64, an axisymmetrical rhombus slot 53 of a one-end open type can be formed in the antenna 33.

Figure 65:
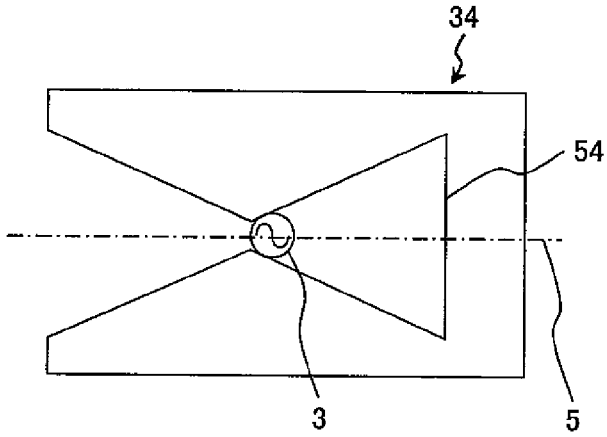
FIG. 65 is a schematic view illustrating a plane view of an antenna in which still another applicable slot is formed according to the present invention.

FIG. 65 is a schematic view illustrating a plane view of an antenna in which still another applicable slot is formed according to the present invention. As shown in FIG. 65, an axisymmetrical bow-tie shape slot 54 of a one-end open type can be formed in the antenna 34.

Figure 66:
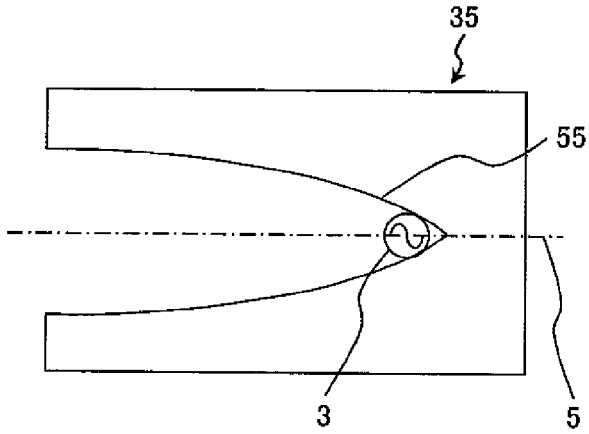
FIG. 66 is a schematic view illustrating a plane view of an antenna in which still another applicable slot is formed according to the present invention.

FIG. 66 is a schematic view illustrating a plane view of an antenna in which still another applicable slot is formed according to the present invention. As shown in FIG. 66, an axisymmetrical ellipse shape slot 55 of a one-end open type can be formed in the antenna 35.

Figure 67:
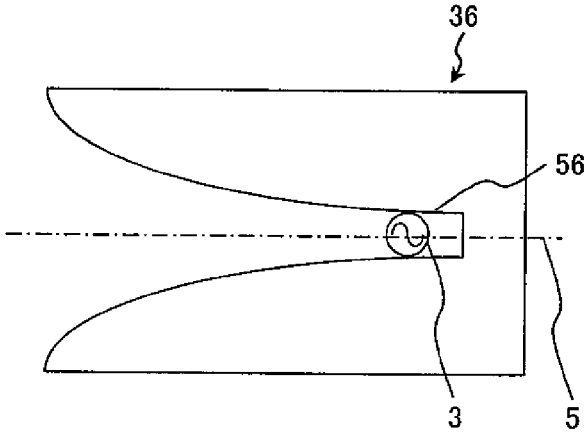
FIG. 67 is a schematic view illustrating a plane view of an antenna in which still another applicable slot is formed according to the present invention.

FIG. 67 is a schematic view illustrating a plane view of an antenna in which still another applicable slot is formed according to the present invention. As shown in FIG. 67, an axisymmetrical horn shape slot 56 of a one-end open type can be formed in the antenna 36.

Figure 68:
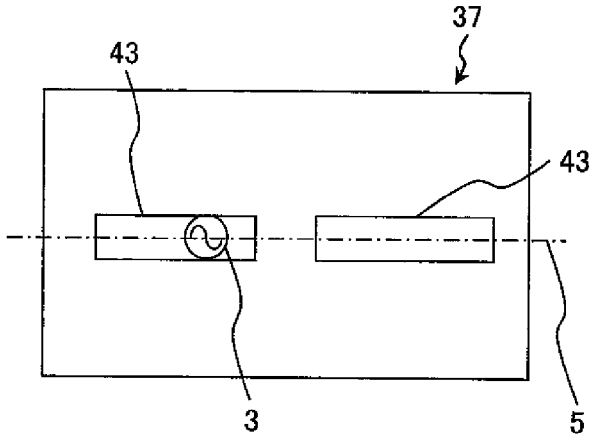
FIG. 68 is a schematic view illustrating a plane view of an antenna in which still another applicable slot is formed according to the present invention.

FIG. 68 is a schematic view illustrating a plane view of an antenna in which still another applicable slot is formed according to the present invention. As shown in FIG. 68, two axisymmetrical rectangle slots 43 of both-end short-circuit type are disposed in a row on the axisymmetrical axis 5 while maintaining the axisymmetrical structure. Furthermore, the feeding point 3 is provided only for one slot.

Figure 69:
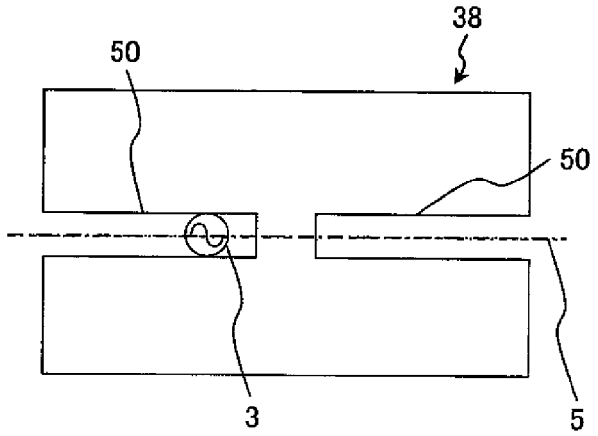
FIG. 69 is a schematic view illustrating a plane view of an antenna in which still another applicable slot is formed according to the present invention.

FIG. 69 is a schematic view illustrating a plane view of an antenna in which still another applicable slot is formed according to the present invention. As shown in FIG. 69, two axisymmetrical rectangle slots 50 of a one-end open type are disposed in a row on the axisymmetrical axis 5 while maintaining the axisymmetrical structure. Furthermore, the feeding point 3 is provided only for one slot.

Figure 70:
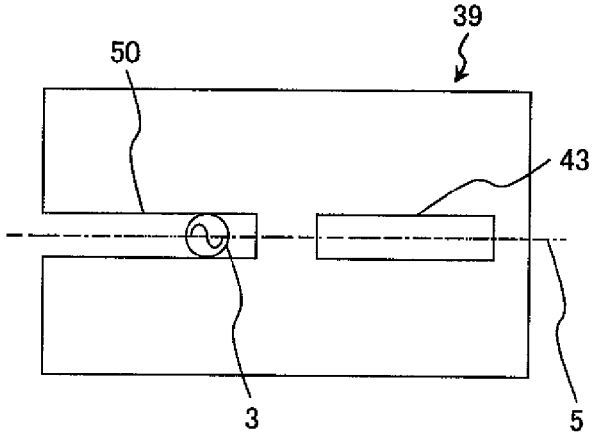
FIG. 70 is a schematic view illustrating a plane view of an antenna in which still another applicable slot is formed according to the present invention.

FIG. 70 is a schematic view illustrating a plane view of an antenna in which still another applicable slot is formed according to the present invention. As shown in FIG. 70, the axisymmetrical rectangle slot 43 of a both-end short-circuit type and the axisymmetrical rectangle slot 50 of a one-end open type are disposed in a row on the axisymmetrical axis 5 while maintaining the axisymmetrical structure. Furthermore, the feeding point 3 is provided only for one slot.

Thus, the shape of the two slots can be identical; the shape of the two slots is of the same type but the width and/or the length can be different. Also, the shape of the slots can be mutually different.

In the aforementioned embodiments of the present invention, an antenna is made by forming a slot in the conductor flat-plate 2, however, other than the conductor flat-plate 2, an antenna can be made by forming a slot in a flexible conductor sheet or film made of a copper foil or an aluminum foil. Furthermore, the coaxial cable 6 is used for feeding power, however, a plurality of single core cables or a flat cable can be used.

[Electronic Device Equipped with Antenna]

Next, an electronic device incorporating an antenna according to the present invention will be explained with reference to FIGS. 71 to 76.

Figure 71:
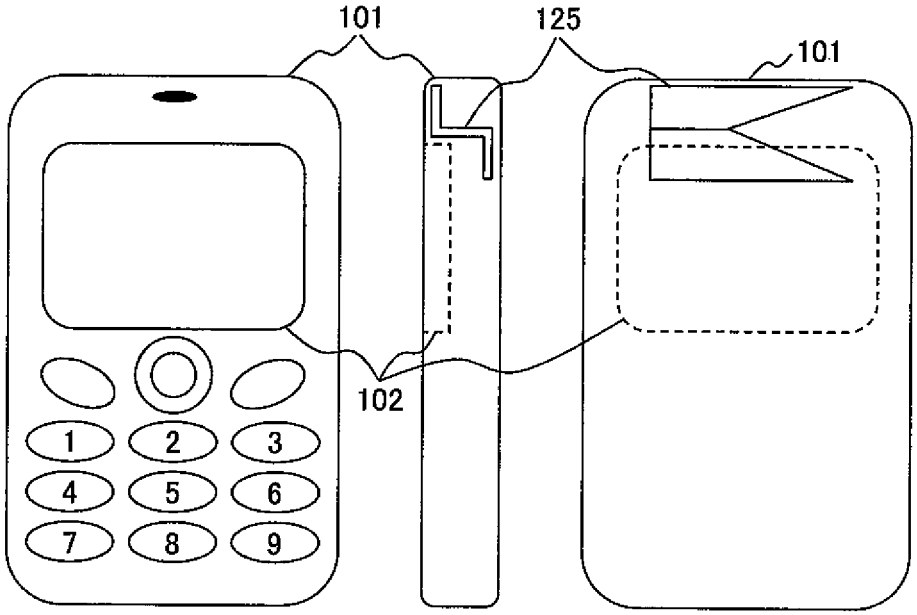
FIG. 71 is schematic views illustrating an example of an electronic device incorporating an antenna according to the present invention.

FIG. 71 is schematic views illustrating an example of an electronic device incorporating an antenna according to the present invention. As shown in FIG. 71, an antenna according to the present invention (e.g., an antenna 125 of the fourth embodiment) can be built into a mobile terminal (e.g., cellular phone, and the like) 101 equipped with a display 102.

Figure 72:
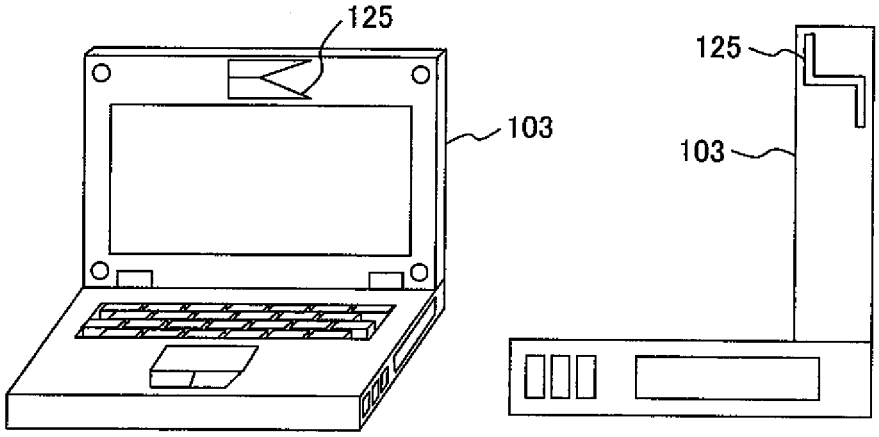
FIG. 72 is schematic views illustrating another example of an electronic device incorporating an antenna according to the present invention.

FIG. 72 is schematic views illustrating another example of an electronic device incorporating an antenna according to the present invention. As shown in FIG. 72, an antenna according to the present invention (e.g., an antenna 125 of the fourth embodiment) can be built into a frame portion (the drawing shows the upper part of the frame) of the display in an electronic device (e.g., notebook computer and the like) 103.

Figure 73:
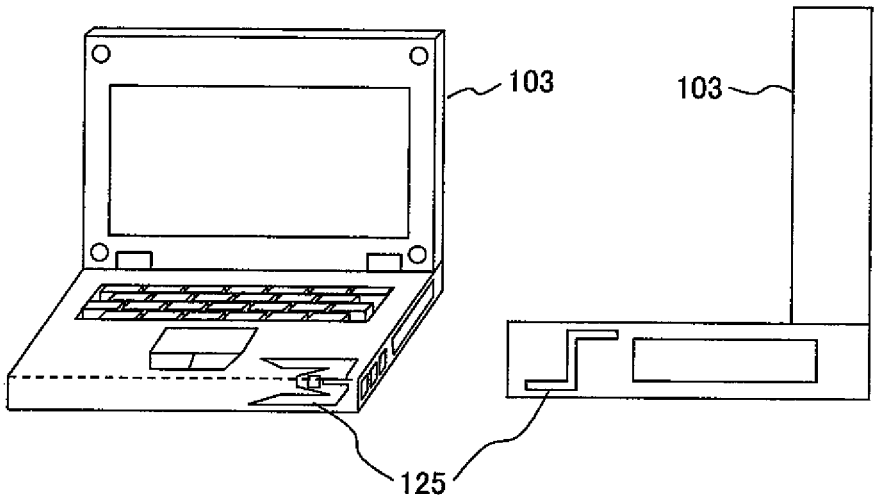
FIG. 73 is schematic views illustrating still another example of an electronic device incorporating an antenna according to the present invention.

FIG. 73 is schematic views illustrating still another example of an electronic device incorporating an antenna according to the present invention. As shown in FIG. 73, an antenna according to the present invention (e.g., an antenna 125 of the fourth embodiment) can be built into a front side portion of the keyboard of the electronic device 103.

Thus, when an antenna according to the present invention is built into an electronic device, it is possible for the antenna's power feeding cable to be disposed in the housing or chassis of the electronic device.

Figure 74:
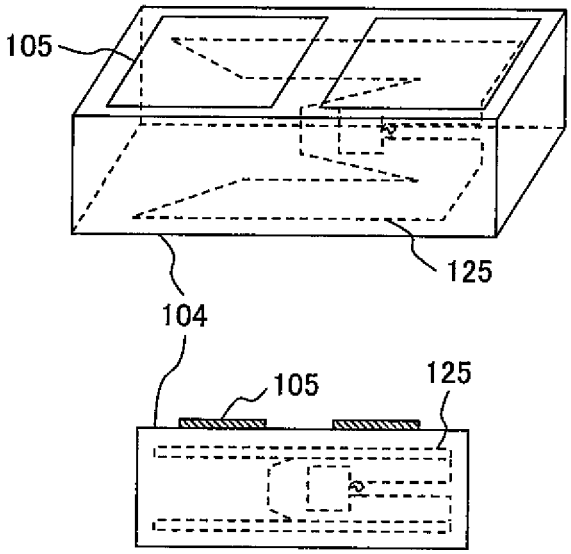
FIG. 74 is schematic views illustrating still another example of an electronic device incorporating an antenna according to the present invention.

FIG. 74 is schematic views illustrating still another example of an electronic device incorporating an antenna according to the present invention. As shown in FIG. 74, an antenna according to the present invention (e.g., an antenna 125 of the fourth embodiment) can be built into an installation unit (e.g., resin case and the like) 104. Then, the installation unit 104 can be installed on a building's wall, ceiling, plate glass window or on an automobile's window glass by an adhesive tape (e.g., double-sided adhesive tape or the like) 105.

Figure 75:
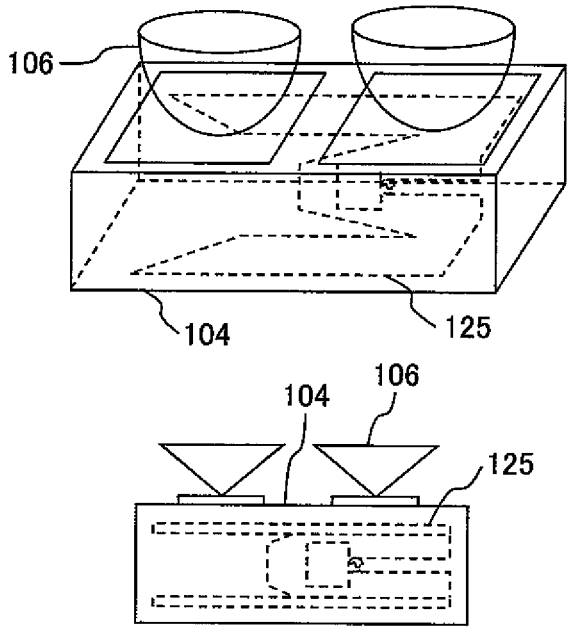
FIG. 75 is schematic views illustrating still another example of an electronic device incorporating an antenna according to the present invention.

FIG. 75 is schematic views illustrating still another example of an electronic device incorporating an antenna according to the present invention. As shown in FIG. 75, an antenna according to the present invention (e.g., an antenna 125 of the fourth embodiment) can be built into the installation unit 104. Then, the installation unit 104 can be installed on a building's wall, ceiling, plate glass window or on an automobile's window glass by an adhesive object (e.g., adhesive disc or the like) 106.

Figure 76:
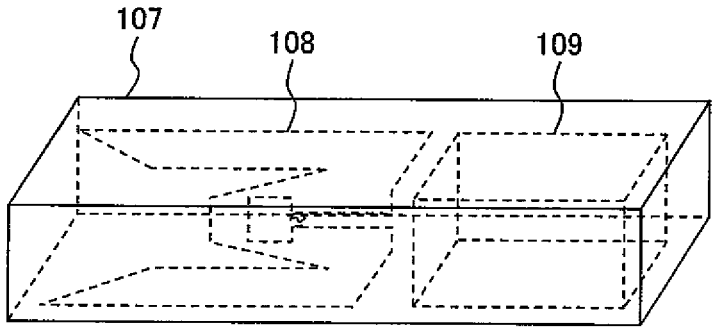
FIG. 76 is schematic views illustrating still another example of an electronic device incorporating an antenna according to the present invention.

FIG. 76 is schematic views illustrating still another example of an electronic device incorporating an antenna according to the present invention. As shown in FIG. 76, two or more wireless systems can be handled by incorporating a cellular compatible antenna 108 according to the present invention into an integrated unit (e.g., resin case and the like) 107 and by incorporating an antenna 109 compatible with wireless systems other than the cellular into a vacant space.

As stated above, an antenna according to the present invention uses two antenna element structures capable of efficiently transmitting and receiving specific polarization components, in which a feeding point is provided only in one of the two antenna element structures, and the two antenna element structures are folded at an equal distance from the axisymmetrical axis passing through the feeding point and the center of the two antenna element structures. And then the resonance characteristics between two different frequency bands can be adjusted by adjusting the size of each antenna element structure; by adjusting the position of the feeding point; or by combining both adjustment methods. Consequently, it is possible to provide a small, simple antenna capable of transmitting and receiving radio waves made up of specific polarization components on the two different frequency bands and tilting in the direction of maximum radiation.

When the antenna according to the present invention is built into a housing of an electronic device or is installed in a piece of equipment which uses metal (conductor), as long as the metal (conductor) portion of the housing or of a piece of equipment does not come close to or come in contact with the portion of each of the two antenna element structures contributing to power radiation and the portion of adjusting resonance characteristics, the antenna elements' characteristics for efficiently transmitting and receiving radio waves are not affected.

As long as a power feeding cable used for an antenna according to the present invention is in a location where the cable does not intersect with the nonconductor region of two antenna elements, the cable does not affect the antenna elements' characteristics for transmitting and receiving radio waves, therefore, the cabling direction can be flexibly selected. Consequently, it is possible to facilitate the arrangement of the power feeding cable when the antenna is built into the housing of an electronic device or in a piece of equipment.

Although the present invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An antenna comprising:

a conductor plate with an axisymmetrical shape;

at least one slot formed on the conductor plate; and a feeding point provided on an axisymmetrical axis of the conductor plate, wherein:

the conductor plate is folded along two locations which are parallel to the axisymmetrical axis toward mutually different directions;

the at least one slot has an axisymmetrical shape and an axisymmetrical axis that matches the axisymmetrical axis of the conductor plate;

the conductor plate has a horizontally rectangular shape oriented in the direction of the axisymmetrical axis;

a composite slot is formed on one part of the axisymmetrical axis of the conductor plate, the composite slot comprising a laterally-facing M-shaped slot and a trapezoid slot with a width gradually becoming larger to an open end and formed in a succession of the laterally-facing M-shaped slot; and a rectangle slot is formed on the other part of the axisymmetrical axis of the conductor plate, thereby a slot boundary conductor portion being formed in the central portion on the axisymmetrical axis of the conductor plate between the composite slot and the rectangle slot.

2. The antenna according to claim 1, wherein the rectangle slot comprises an elongated slot having an open end and a square slot formed in a succession of the elongated slot.

3. The antenna according to claim 2, wherein when $\lambda 1$ is a wavelength of a radio wave at first design frequency $\nu 1$ with respect to two frequency bands used for the composite slot, $2d$ is a width of an upper base of the trapezoid slot, f is a length of the M-shaped slot along the direction of the axisymmetrical axis, and h is a length of each of two sides which connect the upper base and a lower base of the trapezoid slot; d, f, and h are to be adjusted so that a relationship of "$d+f+h=\lambda 1/3.7$" can be established.

4. The antenna according to claim 3, wherein when $\lambda 2$ is a wavelength of a radio wave at second design frequency $\nu 2$ with respect to two frequency bands used for the rectangle slot, g is a length of the elongated slot along the direction of the axisymmetrical axis, e is a width of the elongated slot, and b is a width of a side perpendicular to the axisymmetrical axis of the conductor plate; g, e, and b are to be adjusted so that a relationship of "$g+(b-e)/2=\lambda 2/3.1$" can be established.

5. The antenna according to claim 1, wherein the feeding point is provided to the rectangle slot.

* * * * *